US009260907B2

(12) United States Patent
Nieminen et al.

(10) Patent No.: US 9,260,907 B2
(45) Date of Patent: Feb. 16, 2016

(54) TRIPLE PANE WINDOW SPACER HAVING A SUNKEN INTERMEDIATE PANE

(71) Applicant: Guardian IGU, LLC, White Bear Lake, MN (US)

(72) Inventors: Raimo T. Nieminen, Lempaala (FI); Richard Ahnen, Sparta, WI (US); Paul Terpstra, Janesville, WI (US); David Rapp, Eden Prairie, MN (US); Eric B. Rapp, Avoca, WI (US)

(73) Assignee: Guardian IG, LLC, Sun Prairie, WI (US)

( * ) Notice: Subject to any disclaimer, the term of this patent is extended or adjusted under 35 U.S.C. 154(b) by 0 days.

(21) Appl. No.: 14/058,441

(22) Filed: Oct. 21, 2013

(65) Prior Publication Data

US 2014/0109499 A1 Apr. 24, 2014

Related U.S. Application Data

(60) Provisional application No. 61/716,915, filed on Oct. 22, 2012.

(51) Int. Cl.
*E06B 3/663* (2006.01)
*E06B 7/12* (2006.01)

(52) U.S. Cl.
CPC ..... *E06B 3/66342* (2013.01); *E06B 3/66366* (2013.01); *E06B 7/12* (2013.01)

(58) Field of Classification Search
CPC .... E06B 3/66342; E06B 3/66366; E06B 7/12
USPC ..... 52/172, 204.593, 204.595, 786.1, 52/786.11, 786.13
See application file for complete search history.

(56) References Cited

U.S. PATENT DOCUMENTS

| | | | |
|---|---|---|---|
| 32,436 | A | 5/1861 | Scofield |
| 367,236 | A | 7/1887 | Reinghardt |
| 423,704 | A | 3/1890 | Simpson |
| 1,310,206 | A | 7/1919 | Mowat |
| 2,235,680 | A | 3/1941 | Haven et al. |

(Continued)

FOREIGN PATENT DOCUMENTS

| | | |
|---|---|---|
| CA | 1290624 | 10/1991 |
| CA | 2757945 | 10/2010 |

(Continued)

OTHER PUBLICATIONS

""Edgetech I.G., Super Spacer® Cushion Edge™, Decorative Glass, Foam Space . . . "", http://www.edgetechig.com/SuperSpacer/CushionEdge.aspx May 23, 2011 , 1 page.

(Continued)

*Primary Examiner* — Adriana Figueroa
(74) *Attorney, Agent, or Firm* — Remarck Law Group PLC

(57) ABSTRACT

In one embodiment, a window spacer has an outer elongate strip with a first surface and a second surface. The window spacer also has first and second inner elongate strips that each has a first surface and a second surface. The inner elongate strips are arranged so that each of the first surfaces of the inner elongate strips is spaced from the second surface of the outer elongate strip. The inner elongate strips are also spaced from each other to form an elongate intermediate pane gap. Support legs extend between the outer elongate strip and the two inner elongate strips.

20 Claims, 20 Drawing Sheets

(56) References Cited

U.S. PATENT DOCUMENTS 2,597,097 A 5/1952 Haven
2,618,819 A 11/1952 Goodwille
2,708,774 A 5/1955 Seelen
2,885,746 A 5/1956 Güra
2,838,810 A 6/1958 Englehart et al.
3,027,608 A 4/1962 Ryan
3,045,297 A 7/1962 Ljungdahl
3,143,009 A 8/1964 Pfeiffer
3,280,523 A 10/1966 Stroud et al.
3,288,667 A 11/1966 Martin
3,645,121 A 2/1972 Pfeiffer et al.
3,756,060 A 9/1973 Bindernagel
3,758,996 A 9/1973 Bowser
3,796,080 A 3/1974 Munchbach
3,839,137 A 10/1974 Davis et al.
3,872,198 A * 3/1975 Britton ..... 264/46.6
3,875,706 A * 4/1975 Okawa ..... 52/172
3,921,359 A 11/1975 Brichard et al.
3,935,893 A 2/1976 Stang et al.
3,956,998 A 5/1976 Bavetz
3,981,111 A 9/1976 Berthagen
4,002,048 A 1/1977 Pozsgay
4,027,517 A 6/1977 Bodnar
4,057,944 A 11/1977 Wyatt et al.
4,057,945 A 11/1977 Kessler
4,074,480 A 2/1978 Burton
4,080,482 A * 3/1978 Lacombe ..... 428/34
4,098,722 A 7/1978 Cairns et al.
4,113,799 A 9/1978 Van Ornum et al.
4,113,904 A 9/1978 Kiefer
4,113,905 A 9/1978 Kessler
4,114,342 A 9/1978 Okawa
4,222,213 A 9/1980 Kessler
4,226,063 A 10/1980 Chenel
4,241,146 A 12/1980 Sivachenko et al.
4,244,203 A 1/1981 Pryor et al.
4,382,375 A 5/1983 Yamamoto et al.
4,400,338 A 8/1983 Rundo
4,408,474 A 10/1983 Hutzenlaub et al.
4,431,691 A 2/1984 Greenlee
4,499,703 A 2/1985 Rundo
4,536,424 A 8/1985 Laurent
4,551,364 A 11/1985 Davies
4,561,929 A 12/1985 Lenhardt
4,563,843 A * 1/1986 Grether et al. ..... 52/172
4,564,540 A * 1/1986 Davies et al. ..... 428/34
4,567,710 A 2/1986 Reed
4,576,841 A 3/1986 Lingemann
4,580,428 A 4/1986 Brettbacher et al.
4,654,057 A 3/1987 Rhodes
4,658,553 A 4/1987 Shinagawa
4,719,728 A 1/1988 Eriksson et al.
4,720,950 A 1/1988 Bayer et al.
4,769,105 A 9/1988 Lisec
4,780,164 A 10/1988 Rueckheim et al.
4,791,773 A 12/1988 Taylor
4,808,452 A 2/1989 McShane
4,815,245 A 3/1989 Gartner
4,831,799 A 5/1989 Glover et al.
4,835,130 A 5/1989 Box
4,835,926 A 6/1989 King
4,850,175 A 7/1989 Berdan
4,854,022 A 8/1989 Lisec
4,862,666 A 9/1989 Kero
4,866,967 A 9/1989 Sporenberg et al.
4,881,355 A 11/1989 Bosl et al.
5,052,164 A 10/1991 Sandow
5,079,054 A 1/1992 Davies
5,080,146 A 1/1992 Arasteh
5,087,489 A 2/1992 Lingemann
5,088,258 A 2/1992 Schield et al.
5,113,678 A 5/1992 Mannaka et al.
5,120,584 A 6/1992 Ohlenforst et al.
5,125,195 A * 6/1992 Brede ..... 52/171.3
5,167,756 A 12/1992 Lenhardt
5,182,931 A 2/1993 Noe et al.
5,209,034 A 5/1993 Box et al.
5,254,377 A 10/1993 Lingemann
5,290,611 A 3/1994 Taylor
5,295,292 A 3/1994 Leopold
5,302,425 A 4/1994 Taylor
5,308,662 A 5/1994 Woodard et al.
5,313,762 A 5/1994 Guillemet
5,361,476 A 11/1994 Leopold
5,377,473 A 1/1995 Narayan et al.
5,391,416 A 2/1995 Kunert
5,394,671 A 3/1995 Taylor
5,439,716 A 8/1995 Larsen
5,441,779 A 8/1995 Lafond
5,443,871 A 8/1995 Lafond
5,461,840 A 10/1995 Taylor
5,485,709 A 1/1996 Guillemet
5,512,341 A 4/1996 Newby et al.
5,514,428 A 5/1996 Kunert
5,531,047 A 7/1996 Leopold et al.
5,553,440 A 9/1996 Bulger et al.
5,564,631 A 10/1996 Leopold
5,567,258 A 10/1996 Lee et al.
5,568,714 A * 10/1996 Peterson ..... 52/786.13
5,573,618 A 11/1996 Rueckheim
5,581,971 A 12/1996 Peterson
5,601,677 A 2/1997 Leopold
5,617,699 A * 4/1997 Thompson, Jr. ..... 52/786.13
5,630,306 A * 5/1997 Wylie ..... 52/786.13
5,644,894 A 7/1997 Hudson
5,655,282 A 8/1997 Hodek et al.
5,658,645 A 8/1997 Lafond
5,675,944 A 10/1997 Kerr et al.
5,679,419 A 10/1997 Larsen
5,705,010 A 1/1998 Larsen
5,714,214 A 2/1998 Larsen
5,759,665 A 6/1998 Lafond
5,773,135 A 6/1998 Lafond
5,775,393 A 7/1998 Kovacik
5,813,191 A 9/1998 Gallagher
5,851,609 A 12/1998 Baratuci et al.
5,855,132 A 1/1999 Cozzi
5,879,764 A 3/1999 Chu et al.
5,890,289 A 4/1999 Guillemet
6,035,602 A 3/2000 Lafond
6,038,825 A 3/2000 Shah et al.
6,079,242 A 6/2000 Allegro et al.
6,092,375 A 7/2000 Denniston
6,109,084 A 8/2000 Hutzenlaub et al.
6,115,989 A 9/2000 Boone
6,131,364 A 10/2000 Peterson
6,148,563 A * 11/2000 Roche et al. ..... 49/501
6,148,890 A 11/2000 LaFond
6,183,879 B1 2/2001 Deeley
6,197,129 B1 3/2001 Zhu et al.
6,223,414 B1 5/2001 Hodek et al.
6,250,026 B1 6/2001 Thompson, Jr.
6,266,940 B1 * 7/2001 Reichert ..... 52/786.13
6,289,641 B1 9/2001 McCandless
6,295,788 B2 * 10/2001 Reichert ..... 52/786.13
6,339,909 B1 * 1/2002 Brunnhofer et al. ..... 52/786.13
6,345,485 B1 2/2002 Boone
6,351,923 B1 3/2002 Peterson
6,355,328 B1 3/2002 Baratuci et al.
6,370,838 B1 4/2002 Evason
6,415,561 B2 7/2002 Thompson, Jr.
6,477,812 B2 11/2002 Boone
6,481,222 B1 11/2002 Denniston
6,488,996 B1 12/2002 Ino et al.
6,497,130 B2 12/2002 Nilsson
6,500,516 B2 12/2002 Bourlier
6,528,131 B1 3/2003 Lafond
6,581,341 B1 6/2003 Baratuci et al.
6,622,456 B2 9/2003 Almasy
6,686,002 B2 2/2004 Auerbach
6,715,244 B2 4/2004 Boone
6,796,102 B2 9/2004 Virnelson et al.
6,823,644 B1 * 11/2004 Peterson ..... 52/786.13
6,877,292 B2 4/2005 Baratuci et al.

(56) References Cited

U.S. PATENT DOCUMENTS

| | | | | |
|---|---|---|---|---|
| 6,887,292 | B2 | 5/2005 | Thorwesten | |
| 7,008,492 | B2 | 3/2006 | Lisec | |
| 7,043,881 | B2 | 5/2006 | Krause, Sr. et al. | |
| 7,107,729 | B2 | 9/2006 | Baratuci et al. | |
| 7,132,151 | B2 | 11/2006 | Rasmussen | |
| 7,347,909 | B2 | 3/2008 | Reichert | |
| 7,445,682 | B2 | 11/2008 | James et al. | |
| 7,448,246 | B2 | 11/2008 | Briese et al. | |
| 7,827,761 | B2 | 11/2010 | Buchanan et al. | |
| 7,856,791 | B2 * | 12/2010 | Rosskamp et al. | 52/786.13 |
| 7,938,924 | B2 | 5/2011 | Lisec | |
| 8,025,941 | B2 | 9/2011 | Taylor et al. | |
| 8,114,488 | B2 | 2/2012 | Alvarez | |
| 8,151,542 | B2 * | 4/2012 | Trpkovski | 52/786.13 |
| 8,595,994 | B1 | 12/2013 | Grommesh | |
| 2001/0001357 | A1 | 5/2001 | Reichert | |
| 2001/0015037 | A1 | 8/2001 | Thompson | |
| 2001/0032436 | A1 | 10/2001 | Riegelman | |
| 2003/0041557 | A1 | 3/2003 | Trpkovski et al. | |
| 2003/0074859 | A1 | 4/2003 | Reichert et al. | |
| 2003/0097818 | A1 | 5/2003 | Almasy | |
| 2003/0101664 | A1 | 6/2003 | Trpkovski | |
| 2003/0178127 | A1 | 9/2003 | Lisec | |
| 2005/0055901 | A1 | 3/2005 | Valentz et al. | |
| 2005/0074566 | A1 | 4/2005 | Rouanet et al. | |
| 2005/0166546 | A1 | 8/2005 | Reichert | |
| 2005/0167028 | A1 | 8/2005 | Reichert | |
| 2005/0178078 | A1 | 8/2005 | Valentz et al. | |
| 2005/0227025 | A1 | 10/2005 | Baratuci et al. | |
| 2006/0065345 | A1 | 3/2006 | James et al. | |
| 2006/0101739 | A1 | 5/2006 | Baratuci et al. | |
| 2006/0105158 | A1 | 5/2006 | Fritz et al. | |
| 2006/0130427 | A1 | 6/2006 | Hodek et al. | |
| 2006/0201606 | A1 | 9/2006 | Lisec | |
| 2007/0077376 | A1 | 4/2007 | Mamiya et al. | |
| 2007/0087140 | A1 | 4/2007 | Dierks | |
| 2007/0116907 | A1 | 5/2007 | Landon et al. | |
| 2007/0131338 | A1 | 6/2007 | Lisec | |
| 2007/0160781 | A1 | 7/2007 | Landon et al. | |
| 2007/0178256 | A1 | 8/2007 | Landon | |
| 2007/0178257 | A1 | 8/2007 | Landon | |
| 2008/0060290 | A1 | 3/2008 | McGlinchy et al. | |
| 2009/0120018 | A1 | 5/2009 | Trpkovski | |
| 2009/0120019 | A1 | 5/2009 | Trpkovski | |
| 2009/0120035 | A1 | 5/2009 | Trpkovski | |
| 2009/0120036 | A1 | 5/2009 | Trpkovski | |
| 2009/0123694 | A1 | 5/2009 | Trpkovski | |
| 2009/0223150 | A1 | 9/2009 | Baratuci et al. | |
| 2009/0301637 | A1 | 12/2009 | Reichert | |
| 2010/0065580 | A1 | 3/2010 | McGlinchy et al. | |
| 2010/0200164 | A1 | 8/2010 | Lisec | |
| 2010/0255224 | A1 | 10/2010 | Gubbels et al. | |
| 2011/0104512 | A1 | 5/2011 | Rapp et al. | |
| 2011/0303349 | A1 * | 12/2011 | Nieminen et al. | 156/91 |
| 2012/0151857 | A1 * | 6/2012 | Heikkila et al. | 52/204.593 |
| 2012/0177827 | A1 | 7/2012 | Trpkovski | |
| 2013/0042552 | A1 | 2/2013 | Trpkovski et al. | |
| 2013/0047404 | A1 | 2/2013 | Nieminen et al. | |

FOREIGN PATENT DOCUMENTS

| | | | | |
|---|---|---|---|---|
| DE | 6903785 | | 1/1969 | |
| DE | 1904907 | | 6/1971 | |
| DE | 2452592 | A1 * | 5/1976 | |
| DE | 2613946 | A1 * | 10/1977 | |
| DE | 3529434 | | 2/1986 | |
| DE | 102010005181 | A1 * | 7/2011 | |
| EP | 0054251 | | 6/1982 | |
| EP | 78530 | A2 * | 5/1983 | E06B 3/66 |
| EP | 0113209 | | 7/1983 | |
| EP | 113209 | A2 * | 7/1984 | E06B 3/66 |
| EP | 0 268 886 | | 6/1988 | |
| EP | 0 403 058 | | 12/1990 | |
| EP | 2177703 | | 4/2010 | |
| FR | 2 525 314 | | 10/1983 | |
| GB | 1508778 | | 4/1978 | |
| GB | 1579726 | | 11/1980 | |
| GB | 2 181 773 | | 4/1987 | |
| WO | WO-93/25774 | | 12/1993 | |
| WO | WO-03101709 | | 12/2003 | |
| WO | WO-2004009944 | | 1/2004 | |
| WO | WO-2009064905 | | 5/2009 | |
| WO | WO-2009064909 | | 5/2009 | |
| WO | WO-2009064915 | | 5/2009 | |
| WO | WO-2009064919 | | 5/2009 | |
| WO | WO-2009064921 | | 5/2009 | |
| WO | WO-2011008860 | | 1/2011 | |
| WO | WO-2011156722 | | 12/2011 | |

OTHER PUBLICATIONS

Unknown, "Insulating Glass Production", Glass Digest May 15, 1994 , 4 pages.

""Replacement Window Spacers: The Swiggle Spacer System"", http://www.replacement-windows.com/spacers-swiggle-system.php (downloaded from web site Oct. 10, 2011) 2 pages.

Unknown, "Allmetal—Making windows more exciting.", Allmetal Catalog Pages from the 1990's., 2 pages.

"File History for co-pending, co-owned U.S. Appl. No. 12/270,289", Entitled "Reinforced Window Spacer," Filed on Nov. 13, 2008 (300 pages).

"File History for co-pending, co-owned U.S. Appl. No. 12/270,362", Entitled "Sealed Unit and Spacer With Stabilized Elongate Strip," Filed on Nov. 13, 2008 (190 pages).

"File History for co-pending, co-owned U.S. Appl. No. 12/270,393", Entitled "Material with Undulating Shape," Filed on Nov. 13, 2008 (203 pages).

"File History for co-pending, co-owned U.S. Appl. No. 13/326,501", Entitled "Triple Pane Window Spacer, Window Assembly and Methods for Manufacturing Same," Filed on Dec. 15, 2011 (211 pages).

"Intercept® Spacer Technologies: Your Best Answer to Energy Star™ and EN-1279, GED Integrated Solutions,", http://www.gedusa.com/intercept.php (Jun. 28, 2011 9:08:36 AM), 2 pages.

"PCT Notification Concerning Transmittal of International Preliminary Report on Patentability", from International Application No. PCT/US2008/083441, corresponding to U.S. Appl. No. 12/270,289, issued on May 18, 2010, pp. 1-8.

"PCT Notification Concerning Transmittal of International Preliminary Report on Patentability", from International Application No. PCT/US2008/083449, corresponding to U.S. Appl. No. 12/270,362), issued on May 18, 2010, pp. 1-7.

"PCT Notification Concerning Transmittal of International Preliminary Report on Patentability", from International Application No. PCT/US2008/083435, corresponding to U.S. Appl. No. 12/270,393, issued on May 18, 2010, pp. 1-6.

"PCT Notification Concerning Transmittal of International Preliminary Report on Patentability", from International Application No. PCT/US2011/065470, corresponding to U.S. Appl. No. 13/326,501, issued on Jun. 18, 2013, pp. 1-9.

PCT International Search Report and Written Opinion from co-owned, co-pending, International Application No. PCT/US2008083441, corresponding to U.S. Appl. No. 12/270,289, mailed Jan. 22, 2009, pp. 1-10.

PCT International Search Report and Written Opinion from co-owned, co-pending, International Application No. PCT/US2008083449, corresponding to U.S. Appl. No. 12/270,362, mailed Jan. 22, 2009, pp. 1-8.

PCT International Search Report and Written Opinion from co-owned, co-pending, International Application No. PCT/US2008083435, corresponding to U.S. Appl. No. 12/270,393, mailed Jan. 22, 2009, pp. 1-7.

PCT International Search Report and Written Opinion from co-owned, co-pending, International Application No. PCT/US2011065470, corresponding to U.S. Appl. No. 13/326,501, mailed May 7, 2012, pp. 1-13.

PCT International Search Report and Written Opinion from co-owned, co-pending, International Application No. PCT/US2013/066177, corresponding to U.S. Appl. No. 14/058,441, mailed Dec 11, 2013, pp. 1-14.

(56) References Cited

OTHER PUBLICATIONS

Figures from AT379860 (1 page).
Figures from DE1259823 (2 pages).
Translated Abstract and Figures for CH630993A5 (2 pages).
Translated Abstract and Figures for DE19642669 (4 pages).
Translated Abstract and Figures for DE20200349 (2 pages).
Translated Abstract and Figures for DE4101277 (13 pages).
Translated Abstract and Figures for EP0139262 (3 pages).
Translated Abstract and Figures for EP0078530 (5 pages).
Translated Abstract and Figures for EP0500483 (3 pages).
Translated Abstract and Figures for FR2744165 (3 pages).
Translated Abstract and Figures for WO03074830 (5 pages).
Translated Description and Figures for DE10011759 (5 pages).
Translated Description and Figures for DE2152071 (3 pages).
Translated Description and Figures for WO2010094446 (19 pages).

* cited by examiner

TRIPLE PANE WINDOW SPACER HAVING A SUNKEN INTERMEDIATE PANE

RELATED APPLICATIONS

This application is a non-provisional of "TRIPLE PANE WINDOW SPACER HAVING A SUNKEN INTERMEDIATE PANE," U.S. 61/716,915, filed Oct. 22, 2012, which is incorporated herein by reference.

This application is related to the following U.S. patent applications "TRIPLE PANE WINDOW SPACER, WINDOW ASSEMBLY AND METHODS FOR MANUFACTURING SAME", U.S. 2012/0151857, filed Dec. 15, 2011 ; "SEALED UNIT AND SPACER", U.S. 2009/0120035, filed Nov. 13, 2008 ; "BOX SPACER WITH SIDEWALLS", U.S. 2009/0120036, filed Nov. 13, 2008 ; "REINFORCED WINDOW SPACER", U.S. 2009/0120019, filed Nov. 13, 2008 ; "SEALED UNIT AND SPACER WITH STABILIZED ELONGATE STRIP", U.S. 2009/0120018, filed Nov. 13, 2008 ; "MATERIAL WITH UNDULATING SHAPE" U.S. 2009/0123694, filed Nov. 13, 2008 ; and "STRETCHED STRIPS FOR SPACER AND SEALED UNIT", U.S. 2011/0104512, filed Jul. 14, 2010 ; "WINDOW SPACER APPLICATOR", U.S. 2011/0303349, filed Jun. 10, 2011 ; "WINDOW SPACER, WINDOW ASSEMBLY AND METHODS FOR MANUFACTURING SAME", U.S. Provisional Patent Application Ser. No. 61/386,732, filed Sep. 27, 2010 ; "SPACER JOINT STRUCTURE", US-2013-0042552-A1, filed on Oct. 22, 2012 ; "ROTATING SPACER APPLICATOR FOR WINDOW ASSEMBLY", US 2013/0047404, filed on Oct. 22, 2012 ; "SPACER HAVING A DESICCANT", filed on Oct. 22, 2012 ; and "ASSEMBLY EQUIPMENT LINE AND METHOD FOR WINDOWS", filed on Oct. 21, 2013 ; which are all hereby incorporated by reference in their entireties.

FIELD OF TECHNOLOGY

The technology disclosed herein is generally related to window spacers. More particularly, the technology disclosed herein is related to a window spacers and window assemblies having a sunken intermediate pane.

BACKGROUND

Windows often include two or more facing panes of glass or other material separated by an air space. The air space reduces heat transfer through the window to insulate the interior of a building to which it is attached from external temperature variations. As a result, the energy efficiency of the building is improved, and a more even temperature distribution is achieved within the building.

SUMMARY

The technology disclosed herein generally relates to window spacers. In one embodiment, a window spacer has an outer elongate strip with a first surface and a second surface. The window spacer also has first and second inner elongate strips that each has a first surface and a second surface. The inner elongate strips are arranged so that each of the first surfaces of the inner elongate strips is spaced from the second surface of the outer elongate strip. The inner elongate strips are also spaced from each other to form an elongate intermediate pane gap. A first outer support leg extends between the outer elongate strip and the first inner elongate strip, and a second outer support leg extends between the outer elongate strip and the second inner elongate strip. A first inner support leg extends between the outer elongate strip and the first inner elongate strip, positioned between the two outer support legs. A second inner support leg extends between the outer elongate strip and the second inner elongate strip, positioned between the two outer support legs.

The technology disclosed herein also relates to window assemblies. In one embodiment a window unit has a first, second and intermediate pane, and a spacer, where the spacer has an outer elongate strip and first and second inner elongate strips, each having a first surface and a second surface. The inner elongate strips are arranged so that each of the first surfaces of the inner elongate strips are spaced from the second surface of the outer elongate strip, and the inner elongate strips are spaced from each other to form an elongate intermediate pane gap. A first outer support leg extends between the outer elongate strip and the first inner elongate strip, and a second outer support leg extends between the outer elongate strip and the second inner elongate strip. A first inner support leg extends between the outer elongate strip and the first inner elongate strip, where the first inner support leg is positioned between the two outer support legs. Further, a second inner support leg extends between the outer elongate strip and the second inner elongate strip, where the second inner support leg is also positioned between the two outer support legs. In such an embodiment the spacer extends from the first pane to the second pane, and the spacer supports the intermediate pane on the outer elongate strip. The spacer defines a first sealant cavity having sealant between the first pane and the first outer support leg, and a second sealant cavity having sealant between the second pane and the second outer support leg.

In yet another embodiment a window unit has first pane, a second pane and an intermediate pane that is disposed between the first pane and the second pane. The window unit also has a spacer. The spacer has an outer elongate strip, a first inner elongate strip, and a second inner elongate strip. The outer elongate strip extends from the first pane to the second pane, and the first inner elongate strip extends from the first pane to the intermediate pane. The second inner elongate strip extends from the intermediate pane to the second pane. A first support leg extends between the outer elongate strip and the first inner elongate strip, and a second support leg extending between the outer elongate strip and the second inner elongate strip.

DETAILED DESCRIPTION OF PARTICULAR EMBODIMENTS

Triple pane window assemblies having an inner pane, outer pane and intermediate pane between the inner and outer panes are valued for providing increased insulation values compared to double pane window assemblies. Triple pane window assemblies consistent with the present disclosure include a spacer structure that can secure the intermediate pane while also establishing the spacing of the inner and outer panes.

In some existing designs for triple pane window assemblies, two separate spacers are used between each adjacent pair of panes. These types of arrangements require that four separate seals be formed between the interior air cavities of the window and the exterior environment. In contrast, in window unit designs where a single spacer structure extends between the two outer panes, only two separate seals are required.

In some existing designs for triple pane spacers where a single spacer structure extends between the two outer panes, an air gap is present adjacent to the outer perimeter edge of the intermediate pane. In other existing designs of this type for triple pane spacers, only foam supports the intermediate pane. In these situations, there is sometimes a concern that the weight of the intermediate pane may result in compressing or crushing the spacer in the center. The likelihood of such a result increases as the size of the window assembly, and therefore the weight of the intermediate pane, increases. In many of the spacer embodiments depicted herein, the intermediate pane is supported by an outer elongate strip of a spacer or by a solid structure that is in contact with the outer elongate strip. As a result, the concern about the intermediate pane crushing the spacer structure is eliminated.

Flexibility and twistability can be desirable in a spacer design, and can facilitate reeling of lengths of the spacer and other manufacturing techniques. Many of the spacers described herein have two separate inner elongate strips defining a gap between them instead of a solid single elongate strip. As a result of this type of design and other features described herein, the design has increased flexibility and twistability.

Another concern sometimes associated with triple pane window assemblies is relevant to reflections off of the perimeter edge of the intermediate pane. Sometimes light can reflect off of the outer edge of the intermediate pane in ways that are undesirable. If the outer perimeter of the intermediate pane is not visible to someone viewing the window assembly, then the possibility of undesirable reflections is significantly reduced or eliminated. In many of the spacer embodiments depicted herein, the outer perimeter of the intermediate pane is positioned within the spacer structure and is not visible. As a result, the possibility of undesirable reflections is significantly reduced in window assemblies using these spacer designs.

Figure 1:
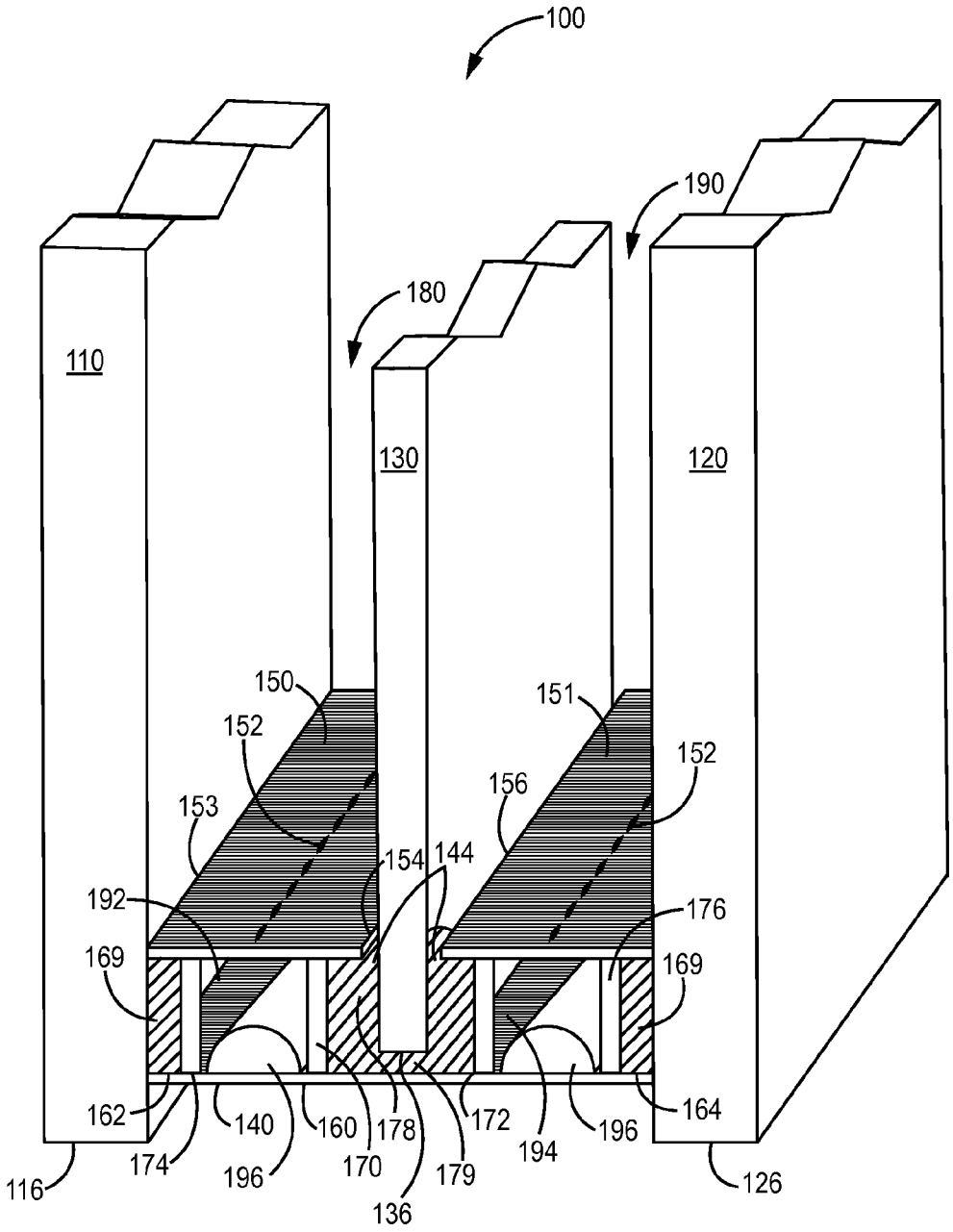
FIG. 1 depicts a partial perspective, cross-sectional view of one implementation of a window assembly described herein.
Figure 2:
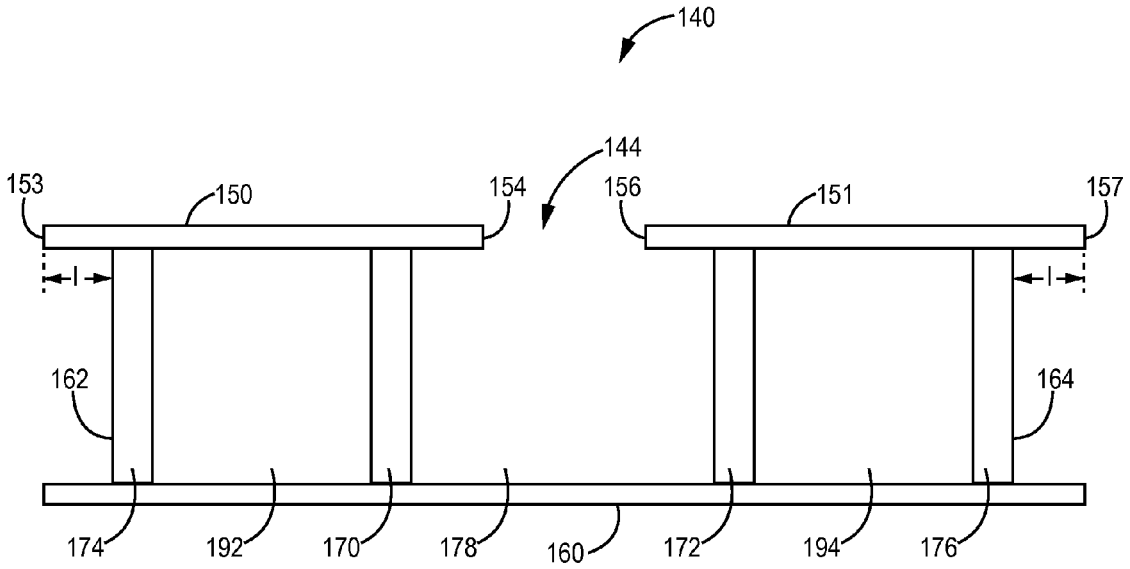
FIG. 2 depicts a cross-sectional view of a spacer component of FIG. 1, consistent with the technology disclosed herein.

FIG. 1 depicts a partial cross-sectional view of one implementation of a spacer incorporated in a triple pane window assembly, consistent with the technology disclosed herein. FIG. 2 depicts a cross-sectional view of the spacer shown in FIG. 1.

Window assembly 100 includes a first sheet 110, a second sheet 120, an intermediate sheet 130 and a spacer 140 disposed between and extending between the first sheet 110 and the second sheet 120. FIG. 1 is a partial view of the window assembly 100 and depicts the spacer 140 contacting the inner-facing surfaces of the first and second sheets 110, 120 adjacent to the bottom perimeters 116, 126 of the first sheet 110 and second sheet 120. It should be understood that the first sheet 110, second sheet 120 and intermediate sheet 130 are window panes in a variety of embodiments. In some embodiments the first sheet 110, second sheet 120 and intermediate sheet 130 are panes of glass, and in other embodiments the first sheet 110, second sheet 120 and intermediate sheet 130 are constructed of other at least partially transparent materials. It should also be understood that the spacer 140 is an elongate structure that is disposed between the first sheet 110 and the second sheet 120 and extends adjacently to the entire perimeters of the sheets 110, 120. A perimeter 136 of the intermediate sheet 130 is in contact with the spacer 140.

Spacer 140 is generally structured to withstand compressive forces applied to the first sheet 110 and/or the second sheet 120 to maintain a desired space between the sheets 110, 120, 130. A first air space 180 is defined within window assembly 100 by the spacer 140, the first sheet 110 and the intermediate sheet 130. A second air space 190 is defined within the window assembly 100 by the spacer 140, the second sheet 120, and the intermediate sheet 130.

The spacer 140 includes two inner elongate strips 150 and 151 and an outer elongate strip 160 spaced from the two inner elongate strips 150 and 151. The terms inner and outer in the names for these parts relates to the fact that, after the window unit is assembled, the outer elongate strip 160 is closer to the outer perimeter of the window assembly than the inner elongate strips 150, 151. Focusing first on the two inner elongate strips 150 and 151, a first inner elongate strip 150 is spaced from a second inner elongate strip by an elongate intermediate pane gap 144, which accommodates the thickness of the intermediate sheet 130. The two inner elongate strips 150 and 151 each define apertures 152. The first inner elongate strip 150 has an outer elongate edge 153 and an inner elongate edge 154. The second inner elongate strip 151 has an outer elongate edge 157 (visible in FIG. 2 but not in FIG. 1) and an inner elongate edge 156.

The elongate intermediate gap 144 is defined between the inner edge 154 of the first inner elongate strip 150 and the inner edge 156 of the second inner elongate strip 151. In some embodiments, the intermediate gap 144 will be wider than the thickness of the intermediate sheet 130 so that the inner edges 154, 156 will not be directly in contact with the intermediate sheet 130. In some embodiments, the inner edges 154, 157 will be spaced from the intermediate sheet 130 by about 0.020 in. (about 0.50 mm) or more.

The first and second inner elongate strips 150, 151 are spaced apart from and face the outer elongate strip 160. Four support legs 170, 172, 174 and 176 extend between the inner elongate strips 150, 151 and the outer elongate strip 160 and establish the spacing there-between. A first inner support leg 170 and a second inner support leg 172 are located near to the intermediate gap 144. A first outer support leg 174 and a second outer support leg 176 are located closer to the outer elongate edges 153, 152.

The two inner support legs 170, 172 define an intermediate cavity 178 between them, where the outer perimeter 136 of the intermediate sheet 130 rests. The intermediate cavity 178 is also partially bounded by portions of the two inner elongate strips 150, 151 and the outer elongate strip 160. The intermediate cavity 178 contains sealant 179, shown in FIG. 1. The sealant 179 is present between the perimeter 136 of the intermediate sheet 130 and the outer elongate strip 160, and serves to seal the spacer 140 to the intermediate sheet 130. As illustrated in FIG. 1, the sealant 179 extends toward the two inner support legs 170, 172. In some embodiments, the sealant 179 fills most of the intermediate cavity 178. In some embodiments, the sealant 179 fills the entire intermediate cavity 178. In some embodiments, the sealant 179 contacts one or both of the inner elongate strips 150, 151. In some embodiments, the sealant 179 is present between the intermediate sheet 130 and the inner edges 154, 156 of the inner elongate strips 150, 151, which can reduce the likelihood of noise caused by contact between the inner edges 154, 156 and the intermediate sheet 130. The presence of sealant 179 in most or all of the cavity 178 can also reduce the likelihood of reflections coming from the perimeter edge 136.

During the assembly of the window unit 100, the intermediate cavity 178 of the spacer 140 can serve as a registration structure which can be used to keep the spacer centered on the equipment and assist with proper placement and positioning of the intermediate sheet 130.

The support legs 170, 172, 174, 176 are also elongate and provide a uniform or substantially uniform spacing between inner elongate strips 150, 151 and outer elongate strip 160, maintaining the strips in a parallel or substantially parallel orientation. In some embodiments, the support legs 170, 172, 174, 176 are substantially parallel to each other. In some embodiments, some of the support legs are angled. The support legs are substantially continuous in multiple embodiments and are arranged at intermediate positions between parallel elongate edges of the elongate strips. In a variety of embodiments, the support legs are constructed of nylon, although those having skill in the art will appreciate other materials that would also be suitable. In one embodiment, the support legs are constructed of a material having mechanical properties so that the support legs can withstand compressive forces and assist with maintaining the desired rigidity of the spacer. The support legs maintain the substantially parallel orientation of the elongate strips during the window assembly process and to some degree in the finished window assembly.

As visible in FIGS. 1 and 2, sealant channels 162, 164 are defined between the elongate edges of the spacer 140 and the outer support legs 174, 176. Generally the channels 162, 164 are inset from the edges of the spacer 140. A first sealant channel 162 is also bounded by the first sheet 110 when the window assembly is assembled. A second sealant channel 164 is bounded by the second sheet 120 when the window assembly is assembled. Sealant 169 present in the sealant channels 162, 164 seals the spacer 140 to the first sheet 110 and the second sheet 120, respectively. The material of the sealant 169 can be similar to or different than the sealant 179 within the intermediate cavity 178.

The inset distance I of the support legs 174, 176, shown in FIG. 2, defines the width of the sealant channels 162, 164. In some embodiments, the inset distance I is 0.01 inch (0.25 mm) or more. In one embodiment, the inset distance is 0.1 inch (2.54 mm) or less. In other embodiments, the inset distance I is 0.035 inch (0.89 mm) or more, 0.04 inch (1.02 mm) or more, and 0.07 inch (1.78 mm) or more. In the specific embodiment illustrated in the FIGS. 1 and 2, the inset distance I is about 0.075 inch (1.9 mm). In another embodiment, the inset distance I is about 0.0375 inch (0.95 mm). Sealant or adhesive generally occupies the channels 162, 164 so that the sealant or adhesive thickness is typically the same thickness as the inset distance I. In different embodiments, the sealant or adhesive thickness is 0.08 inch (1.03 mm) or more, 0.5 inch (12.7 mm) or less, and about 0.175 inch (4.4 mm).

Sealant 169 is generally deposited within the channels 162, 164 when assembling the window assembly 100 so that gas and liquid are inhibited from entering the space disposed between the first and second sheets 110, 120. It is also possible for a non-sealant adhesive material to be deposited in the channels. In some embodiments, sealant is formed of a material having adhesive properties, such that the sealant acts to fasten the spacer 140 to at least the first sheet 110 and the second sheet 120. The material in each channel 162, 164 contacts the inner faces of the first and second inner elongate strips and the inner face of the outer elongate strip in some embodiments, as well as contacts the inner face of the adjacent sheet 110 or 120, and the adjacent outer support leg 174, 176. Typically, the material is arranged to support the spacer 140 in an orientation normal to inner faces of the first and second sheets 110, 120. If sealant is used, it also acts to seal the joint formed between the spacer 140 and the sheets 110, 120 to inhibit gas or liquid intrusion into the first air space 180 or the second air space 190. Examples of sealants include polyisobutylene (PIB), butyl rubber, curable PIB, silicone, adhesive for example acrylic adhesives; sealant for example acrylic sealants; and other Dual Seal Equivalent (DSE) type materials.

During one embodiment of an assembly method of a window unit, sealant or adhesive is placed in the intermediate channel 178 and in the outer sealant channels 162, 164. The intermediate sheet 130, spacer 140, or both are manipulated in order to wrap the spacer 140 around the perimeter edge 136 of the intermediate sheet 130. The first and second sheets 110, 120 are brought into contact with the elongate edges of the spacer 140. During this step, the sealant or adhesive is under some pressure. This pressure helps to strengthen the bond between the sealant or adhesive material and the first and second sheets 110, 120. Another effect of the pressure is that the material typically spills out of the sealant channels 162, 164 slightly, thereby contacting the top and bottom surfaces of the elongate edges of the spacer 140 and providing a barrier at the juncture of the spacer 140 and the first and second sheets 110, 120. Such contact is not required in all embodiments. However, the additional contact area between material and the spacer 140 can be beneficial. For example, the additional contact area increases adhesion strength. As will be described in more detail herein, in a variety of embodiments the elongate strips 150, 151, 160 define undulations. Such undulations of the elongate strips 150, 151, 160 also aid in improving the adhesion with the material. Further details regarding embodiments of the assembly process and applicator apparatus will be described herein, and are also described in U.S. patent application Ser. No. 13/157,866, "WINDOW SPACER APPLICATOR", filed Jun. 10, 2011 .

Two filler cavities 192, 194 are defined by the spacer structure and include filler 196. A first filler cavity 192 is defined between the first outer support leg 174 and the first inner support leg 170. A second filler cavity 194 is defined between the second inner support leg 172 and the second outer support leg 176. The filler cavities 192, 194 are also bounded by inner elongate strips 150, 151 and the outer elongate strip 160. Filler material 196 is present in each of the filler cavities 192, 194.

In the embodiments shown in the drawings, the filler 196 is located on the outer elongate strip 160. In other embodiments, a bead of filler is located on an inner elongate strip or both of the inner elongate strips 150, 151. In one embodiment, the bead of filler on one or both of the inner elongate strips does not overlap with the openings 152.

Figure 4:
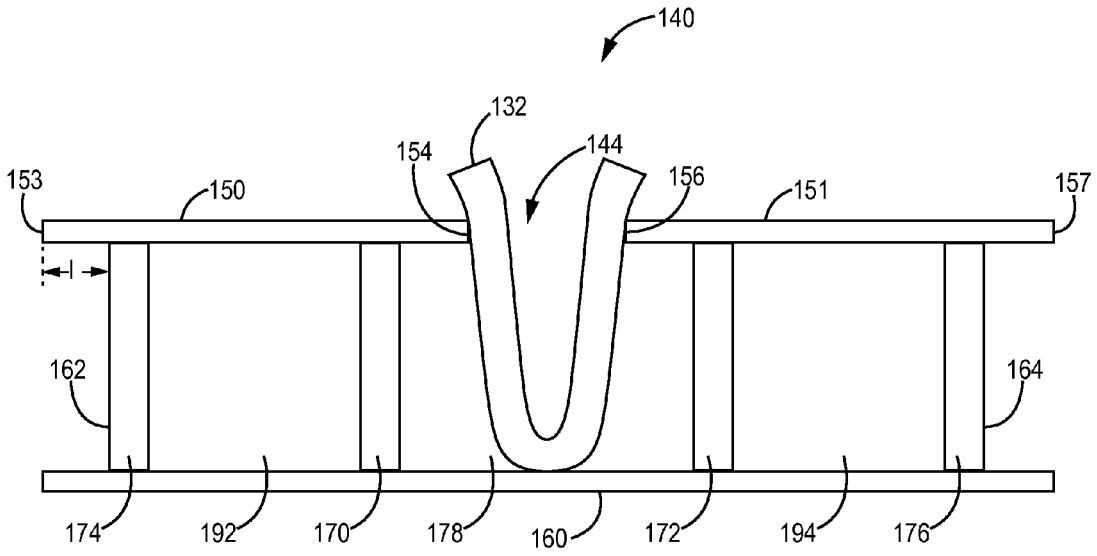
FIG. 4 depicts a cross-sectional view of another spacer component consistent with the technology disclosed herein

FIG. 4 depicts a cross sectional view of an alternate spacer component consistent with the technology disclosed herein, where like reference numbers are used for like parts. Similar to FIG. 2, the spacer has a first inner elongate strip 150 defining a first inner elongate edge 154 and a second inner elongate strip 151 defining a second inner elongate edge 156. An intermediate pane gap 144 is additionally defined by an elongate gasket 132 sealably disposed between the first inner elongate edge 154 and the second inner elongate edge 156. The elongate gasket 132 engages the first inner elongate edge 154 and the second inner elongate edge 156 and defines the intermediate pane gap 144 from outside the intermediate cavity 178 to inside the intermediate cavity 178. The elongate gasket 132 is generally configured to provide a frictional fit with an intermediate sheet, such that the elongate gasket 132 is compressed between the intermediate sheet and the first inner elongate edge 154 and compressed between the intermediate sheet and the second inner elongate edge 156. The elongate gasket 132 can also be configured to prevent contact between the inner elongate strips 150, 151 and an intermediate sheet. The elongate gasket 132 can also be configured to secure an intermediate sheet to prevent shifting of the intermediate sheet relative to the spacer 140.

The elongate gasket 132 can be a compressible material in a variety of embodiments. In a variety of embodiments the elongate gasket 132 is an extruded material. In at least one embodiment the elongate gasket 132 is a UV-curable material. In one embodiment, the elongate gasket 132 is polyisobutene (PIB). In some embodiments the elongate gasket 132 is extruded between the first inner elongate strip 150 and the second inner elongate strip 151. In some other embodiments the elongate gasket 132 is extruded or molded separately and then inserted between the first inner elongate edge 154 and the second inner elongate edge 156. In one embodiment, however, an elongate gasket is disposed about the perimeter of an intermediate sheet and then placed between the first inner elongate strip and the second inner elongate strip. In some embodiments, two or more elongate gaskets are incrementally disposed along the length of the spacer or, alternatively, about the perimeter of the intermediate sheet.

Figure 5:
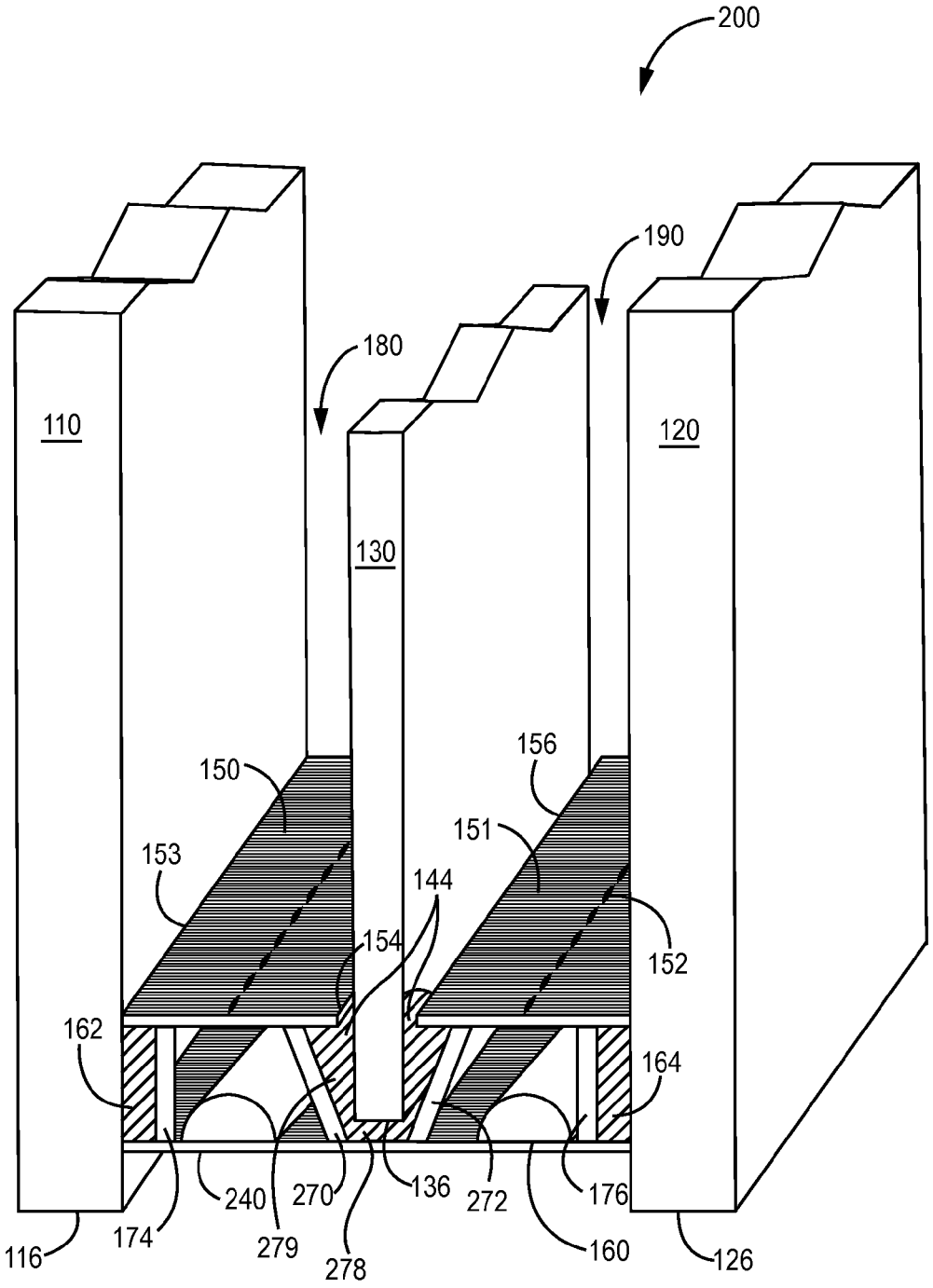
FIG. 5 depicts a partial perspective, cross-sectional view of another implementation of a window assembly described herein.
Figure 6:
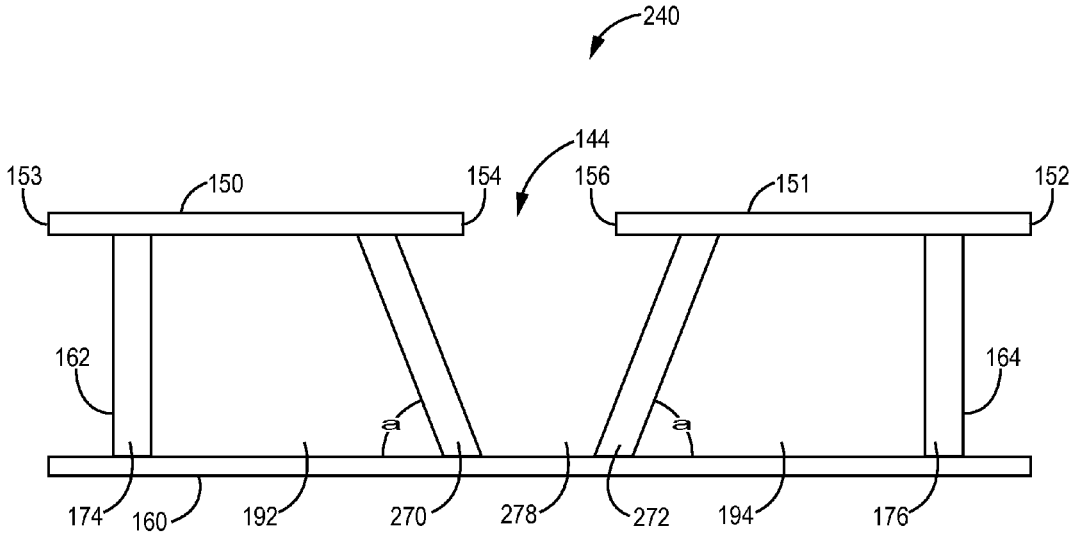
FIG. 6 depicts a cross-sectional view of a spacer component of FIG. 5, consistent with the technology disclosed herein.

An alternative embodiment of a triple pane window assembly 200 and spacer 240 is illustrated in FIGS. 5 and 6. The window assembly 200 is identical to the window assembly 100 except that a different spacer 240 is used. Like reference numbers are used for like parts in the window assembly and spacer drawings. The spacer 240 has angled inner support legs 270 and 272 rather than the inner support legs 170 and 172 that are substantially perpendicular to the elongate strips in spacer 140 of FIGS. 1 and 2. The ends of the support legs 270, 272 that contact the outer elongate strip 160 are closer together than the ends of the support legs 270, 272 that contact the inner elongate strips 150, 151. The angled inner support legs 270, 272 are boundaries for the intermediate cavity 278. As a result of the angle of the inner support legs 270, 272, the cavity 278 has a smaller volume and therefore requires less sealant 279. During assembly of the window assembly 200, the angled support legs 270, 272 may serve to guide the intermediate sheet 130 into the correct position in contact with the outer elongate strip 160.

As illustrated in FIG. 6, an angle a is defined between each of the angled support legs 270, 272 and the portions of the outer elongate strip 160 that are closer to the outer edges of the spacer 240. In one embodiment, the angle $\alpha$ is about 65 to 70 degrees. In one embodiment, the angle $\alpha$ is about 60 to 75 degrees.

Figure 6A:
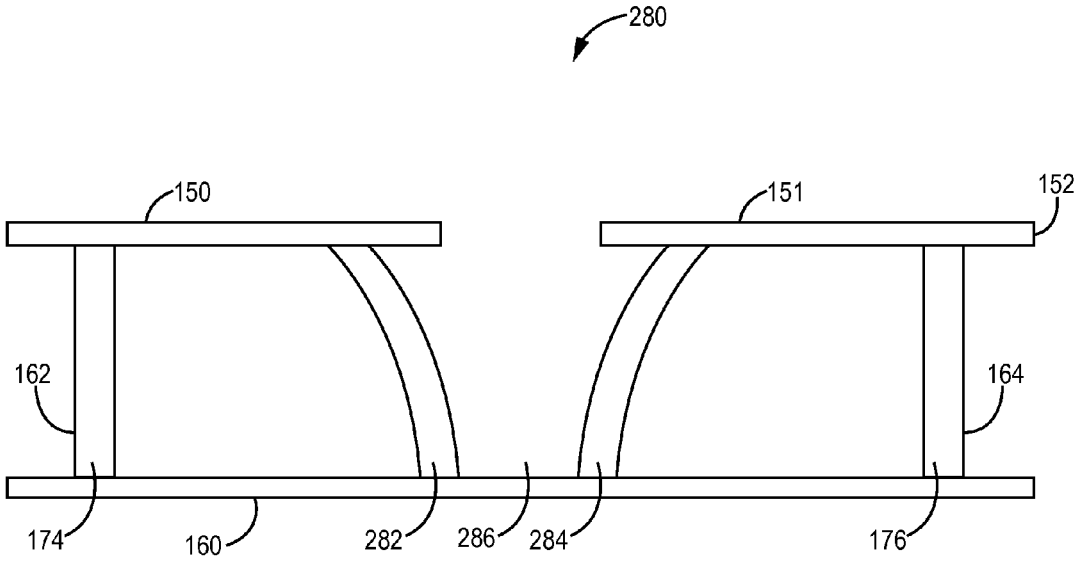
FIG. 6A depicts a cross-sectional view of another embodiment of a spacer.

FIG. 6A illustrates another alternative embodiment 280 of a spacer, which has many similarities and shared reference numbers with the other spacer embodiments. Spacer 280 has angled inner support legs 282 and 284 which are bowed inwardly. The ends of the support legs 282, 284 that contact the outer elongate strip 160 are closer together than the ends of the support legs 282, 284 that contact the inner elongate strips 150, 151. The angle of the inner support legs 282 and 284 can be similar or different than that discussed for the embodiment of FIG. 6. During assembly of a window assembly, the angled support legs 282, 284 may serve to guide an intermediate pane into the correct position in contact with the outer elongate strip 160.

Figure 7:
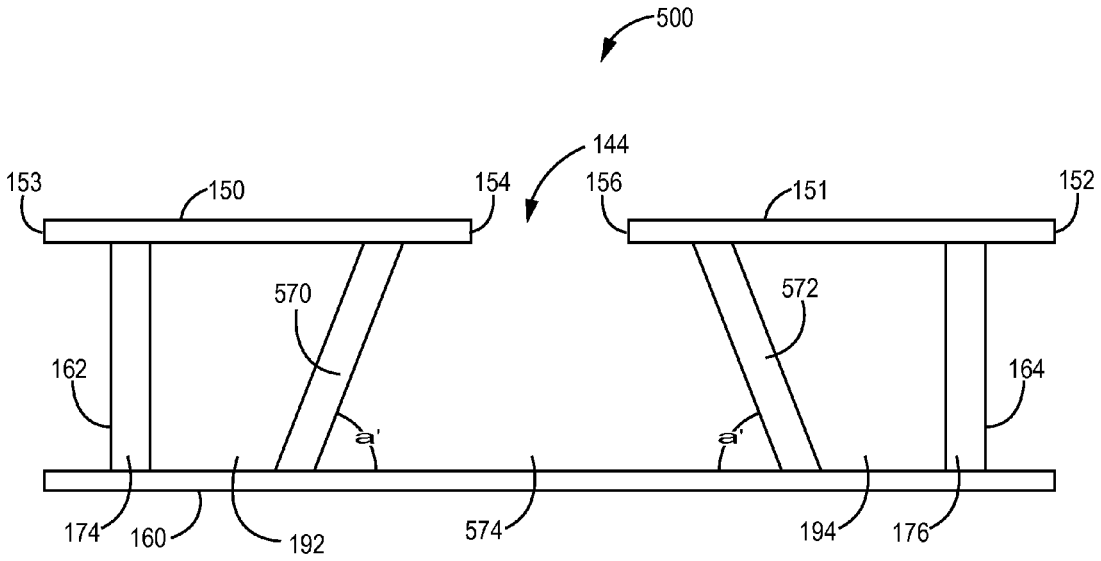
FIG. 7 depicts a cross-sectional view of yet another embodiment of a spacer.

FIG. 7 illustrates another alternative embodiment 500 of a spacer, which again has many similarities and shared reference numbers with the other spacer embodiments. Spacer 500 has inner support legs 570 and 572 which are angled in an opposite direction compared to the inner support legs of FIG. 6. The ends of the support legs 570, 572 that contact the inner elongate strips 150, 151 are closer together than the ends of the support legs 570, 572 that contact the outer elongate strip 160.

As illustrated in FIG. 7, an angle $\alpha'$ is defined between each of the angled support legs 570, 572 and the portions of the outer elongate strip 160 within the intermediate cavity 574. In one embodiment, the angle $\alpha'$ is about 65 to 70 degrees. In one embodiment, the angle $\alpha'$ is about 60 to 75 degrees.

Figure 8:
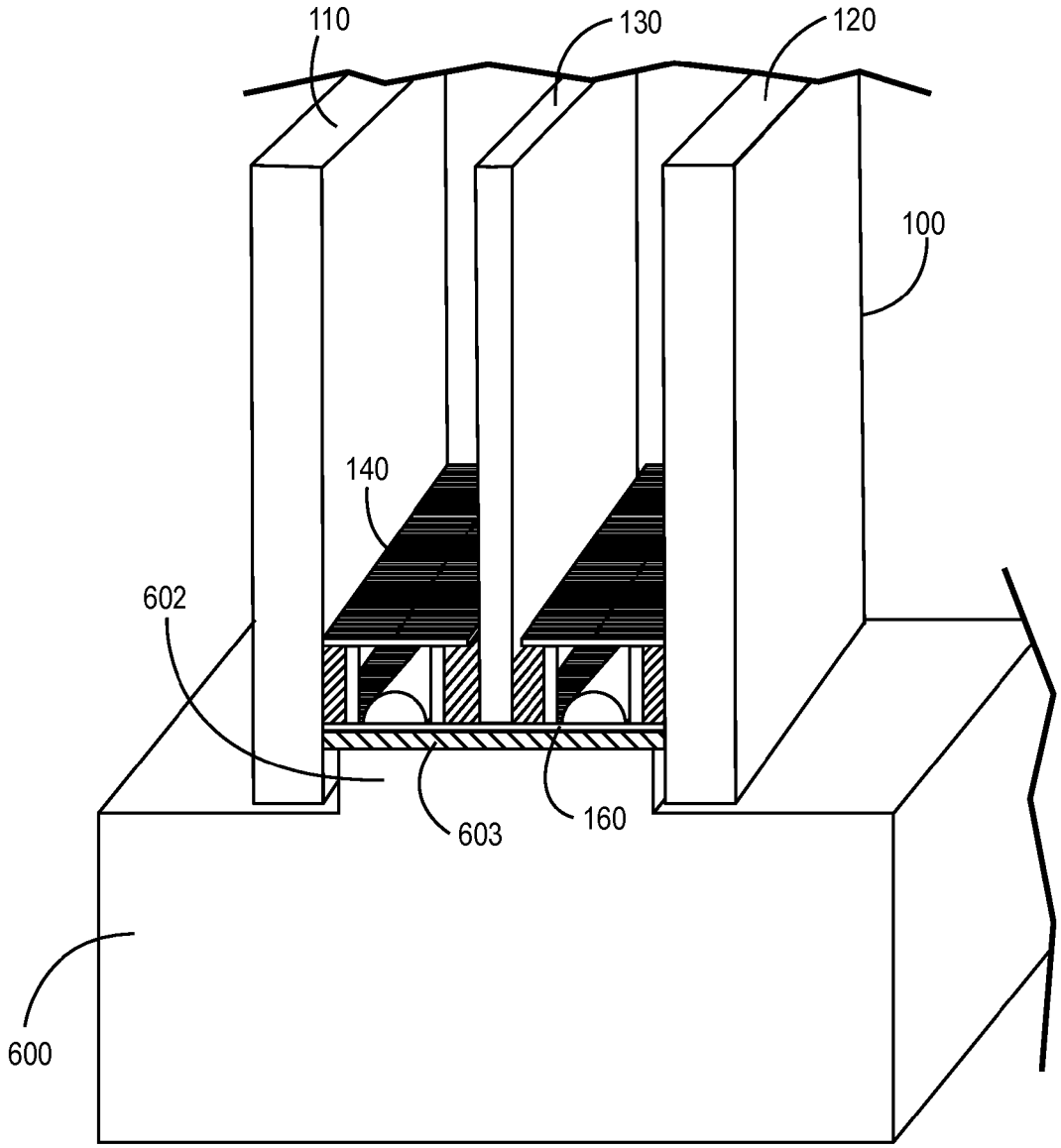
FIG. 8 depicts a setting block used to assist with handling triple pane window assemblies.

FIG. 8 is a cross-sectional view of a small portion of the window unit 100 being supported on a structure 600 that includes a ridge 602. The ridge 602 protrudes into the space between outer panes 110, 120 to support the outer elongate strip 160 of the spacer, which is in turn supporting the intermediate sheet 130. Sash structures, frame structures and other structures that incorporate the window unit 100 may incorporate such a support structure 600 in order to provide support to the intermediate sheet 130. As the size of the window unit 100 increases, the support provided by the support structure 600 becomes more desirable. A secondary sealant 603 may be present at the outer perimeter of the spacer 140 along the outer elongate strip 160.

Figure 9:
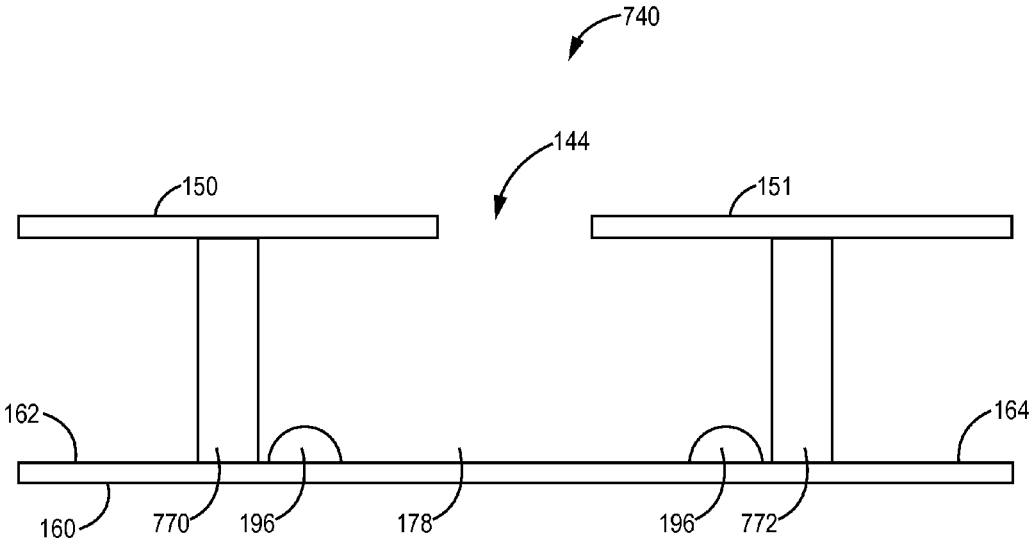
FIGS. 9 to 13 depicts cross-sectional views of further implementations of a spacer component.

An alternative embodiment of a spacer 740 for a triple pane window assembly is illustrated in FIG. 9. In many ways, the components of the spacer 740 in FIG. 9 are identical to the spacer 140 of FIGS. 1 and 2, and like reference numbers are used for like parts in the spacer drawings. One difference is that spacer 740 employs two support legs, a first support leg 770 and a second support leg 772, rather than four support legs. The support legs 770, 772 of spacer 740 can be wider in one embodiment than the support legs 170, 172, 174, 176 of spacer 140 of FIGS. 1 and 2. In one example, the support legs 770, 772 have a thickness of about 0.050 inch, while the support legs 170, 172, 174, 176 have a thickness of about 0.030 inch. Filler 196 is located in an intermediate cavity 178 defined between the two support legs 770, 772 and between the inner elongate strips 150, 151 and the outer elongate strip 160. In one embodiment, two strands of filler 196 are located in the intermediate cavity 178.

Figure 10:
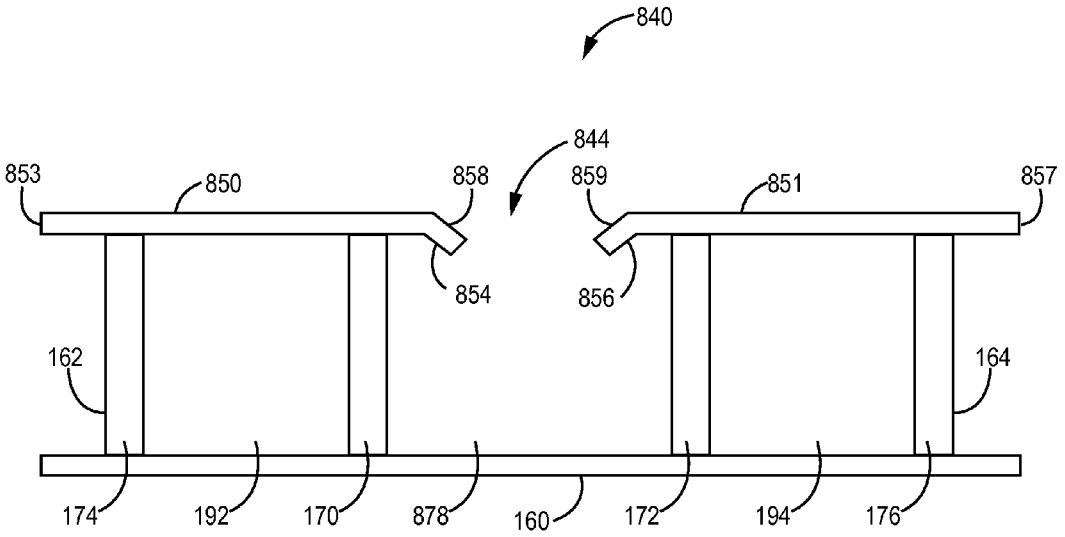

An alternative spacer 840 is shown in FIG. 10. Spacer 840 is identical to spacer 140 in FIGS. 1 and 2 in many ways, and like reference numbers are used for like parts. The difference between spacer 840 and spacer 140 is that spacer 840 includes two inner elongate strips 850, 851 which each have an angled portion 858, 859 at an inner edge 854, 856. The angled portion 858, 859 of each inner elongate strip 850, 851 slopes toward the outer elongate strip 160, while the remainder of each inner elongate strip 850, 851 is substantially parallel to the outer elongate strip 160. An intermediate cavity 878 is defined between the inner elongate strips 850, 851 and the outer elongate strip 160. The intermediate cavity 878 is also defined by the two inner support legs 170, 172. As discussed with respect to the embodiments of FIGS. 1 and 2, sealant is placed in the intermediate cavity 878 and the sealant serves to secure an intermediate pane to the outer elongate strip 160 of the spacer 840. The angled portions 858, 859 help to retain sealant within the intermediate cavity 878.

Figure 11:
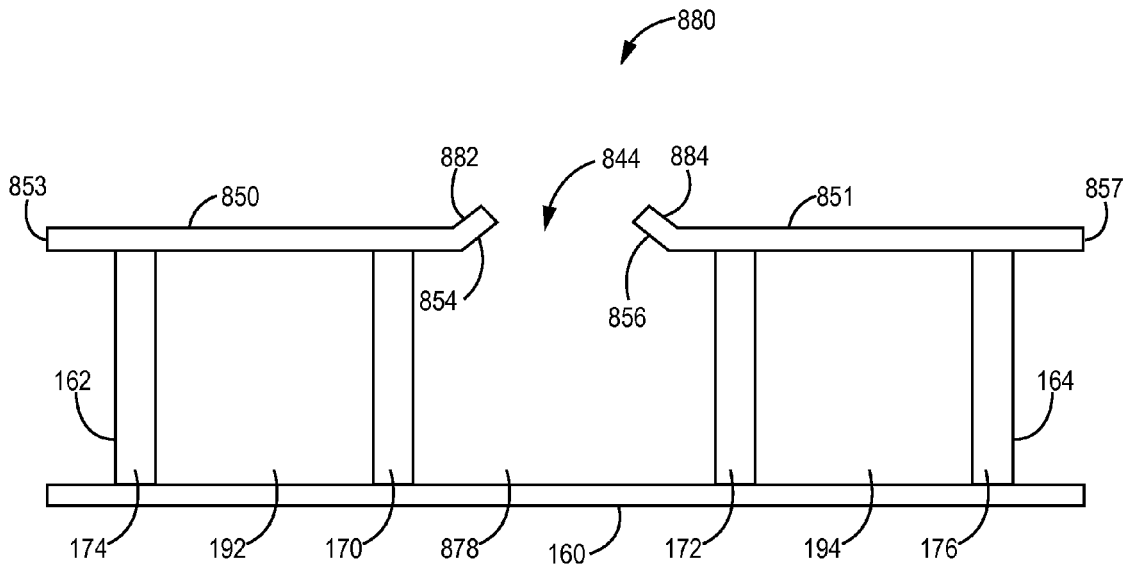

An alternative spacer 880 is shown in FIG. 11, which is mostly identical to spacer 840 of FIG. 10. However, in contrast to spacer 840 of FIG. 10, the spacer 880 of FIG. 11 has angled portions 882, 884 that are angled upwardly away from the outer elongate strip 160

Figure 12:
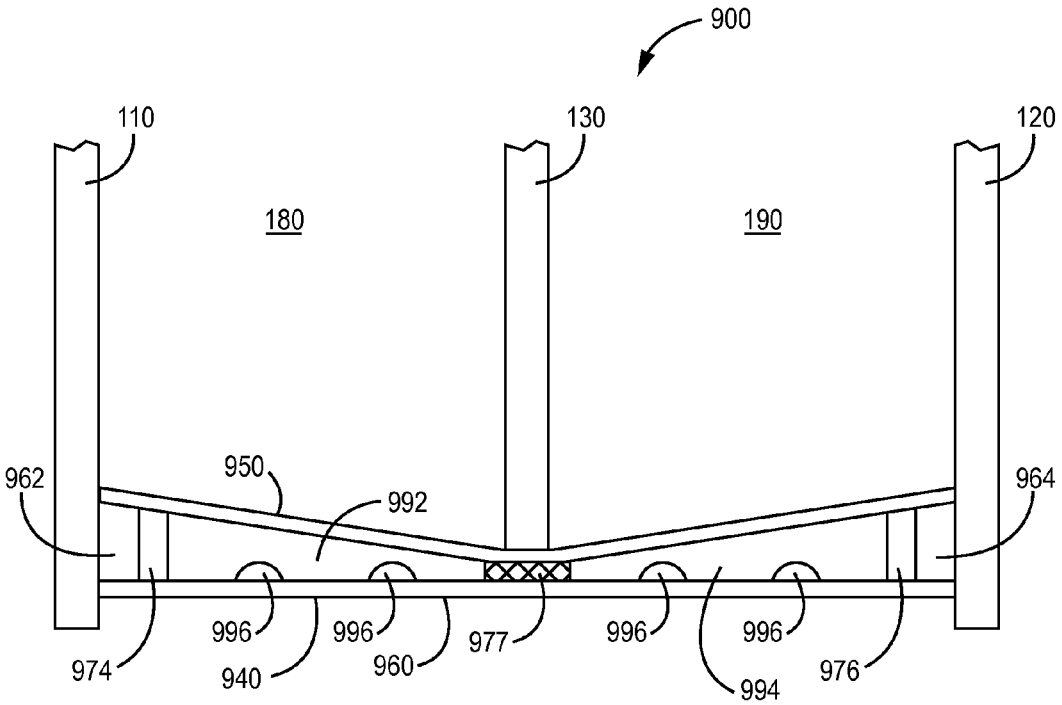

FIG. 12 illustrates an alternative triple pane window assembly 900 that uses an alternative spacer 940. Like reference numbers are used to refer to like parts compared to other Figures. The window assembly 900 includes a first sheet 110, a second sheet 120 and an intermediate sheet 130. Like window assembly 100 of FIG. 1, the spacer 940 includes an outer elongate strip 960. The spacer 940 also includes a single inner elongate strip 950.

The inner and outer elongate strips 950, 960 are spaced from each other and are connected to each other by a structural element 977. Examples of materials that can be used for the structural element are thermoplastic materials that have sufficient structural properties such as rigidity to support the intermediate sheet 130. In some embodiments, the structural element 977 also incorporates a desiccant. In some embodiments, the structural element is capable of forming a seal. One specific example of a suitable material that has sufficient rigidity, is capable of forming a seal and incorporates a desiccant is Koedimelt Thermo Plastic Spacer material sold by Koemmerling Chemische Fabrik Gmbh of Pirmasens, Germany.

In one embodiment, the material of the structural element 977 can be extruded into position on the inner 950 or outer elongate strip 960. The structural element 977 has a thickness extending from the inner to the outer elongate strip of about 0.050 to 0.200 inch in some embodiments, or about 0.150 to 0.200 inch in some embodiments. The structural element 977 has a width that is about the same or larger than the thickness of the intermediate sheet 130 in some embodiments.

The intermediate sheet 130 contacts the inner elongate strip 950 at the location where the inner elongate strip 950 is supported by and is in contact with the structural element 977. As a result, the spacer 940 is not crushed at that location. In some embodiments, sealant, adhesive or adhesive tape is used to secure the intermediate sheet 130 to the inner elongate strip 950.

The elongate strips 950, 960 both have an undulating shape that extends across the width of each strip, as discussed in more detail herein, in some embodiments, or may have a portion of planar, non-undulating material in the center of each strip where each strip contacts the structural element 977 in some embodiments. In one embodiment, the outer elongate strip 960 has undulations across the entire width and the inner elongate strip 950 has undulations except for a planar center portion. In one embodiment, the inner elongate strip 950 has undulations across the entire width and the outer elongate strip 960 has undulations except for a planar center portion.

In some embodiments, the spacer 940 includes a first support leg 974 and a second support leg 976. In some embodiments, the spacer 940 does not include any support legs. Spacer 940 embodiments without any support legs will have increased flexibility and twistability compared to embodiments with support legs, which can be an advantage during reeling of lengths of spacer and other manufacturing steps. The presence of the support legs 974, 976 in some embodiments provides a backstop surface for sealant placed in sealant cavities 962, 964, and therefore allows the window unit to be assembled with a lower volume of sealant being used in the sealant cavities.

The spacer 940 defines two filler cavities 992, 994 between the elongate strips 950, 960. A first filler cavity 992 is defined between the structural element 977 and the first support leg 974, if present, or the first sheet 110. A second filler cavity 994 is defined between the structural element 977 and the second support leg 976, if present, or the second sheet 120. Filler 996 is present in the filler cavities in some embodiments. In one embodiment, two strands of filler 996 are present in each of the filler cavities as illustrated in FIG. 12. In one embodiment, one strand of filler 996 is present in each filler cavity.

Figure 13:
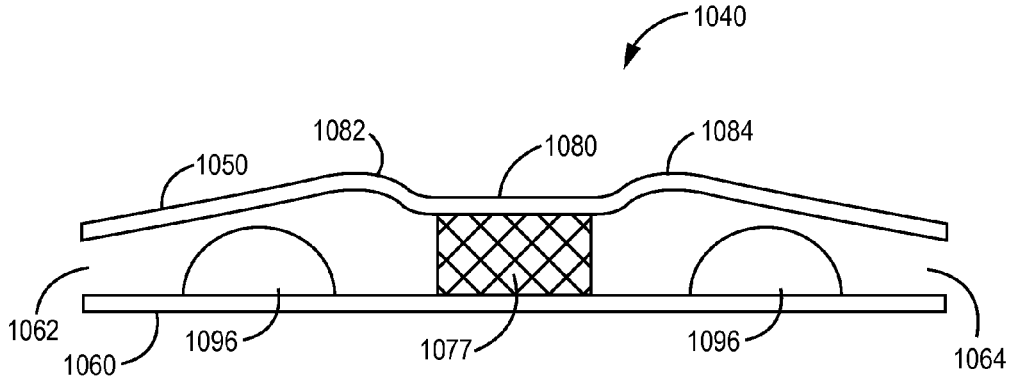

An alternative spacer embodiment 1040 for a triple pane window assembly is illustrated in FIG. 13. An inner elongate strip 1050 faces an outer elongate strip 1060, and they are connected by a structural element 1077. Examples of materials that can be used for the structural element 1077 are thermoplastic materials.

In one embodiment, the material of the structural element 1077 can be extruded into position on the inner elongate strip 1050 or outer elongate strip 1060. The structural element 1077 has a thickness extending from the inner elongate strip 1050 to the outer elongate strip 1060 of about 0.050 to 0.300 inches in some embodiments, or about 0.200 to 0.300 inch in some embodiments. The structural element 1077 has a width that is about the same or larger than the thickness of an intermediate pane in some embodiments.

When the spacer 1040 is used in a triple pane window assembly, an intermediate pane will contact the inner elongate strip 1050 at an intermediate pane location 1080 where the inner elongate strip 1050 is supported by and in contact with the structural element 1077. As a result, the spacer 1040 is not crushed at that location by the weight of the intermediate pane. In some embodiments, sealant, adhesive or adhesive tape is used to secure the intermediate pane to the inner elongate strip 1050.

The inner elongate strip 1050 is structured so that the intermediate pane location 1080 is notched downward between the adjacent raised portions 1082, 1084. The notch structure of the intermediate pane location 1080 can be helpful in serving as a registration structure for locating the intermediate pane. Sealant channels 1062, 1064 are defined at the edges of the spacer 1040.

Figure 14:
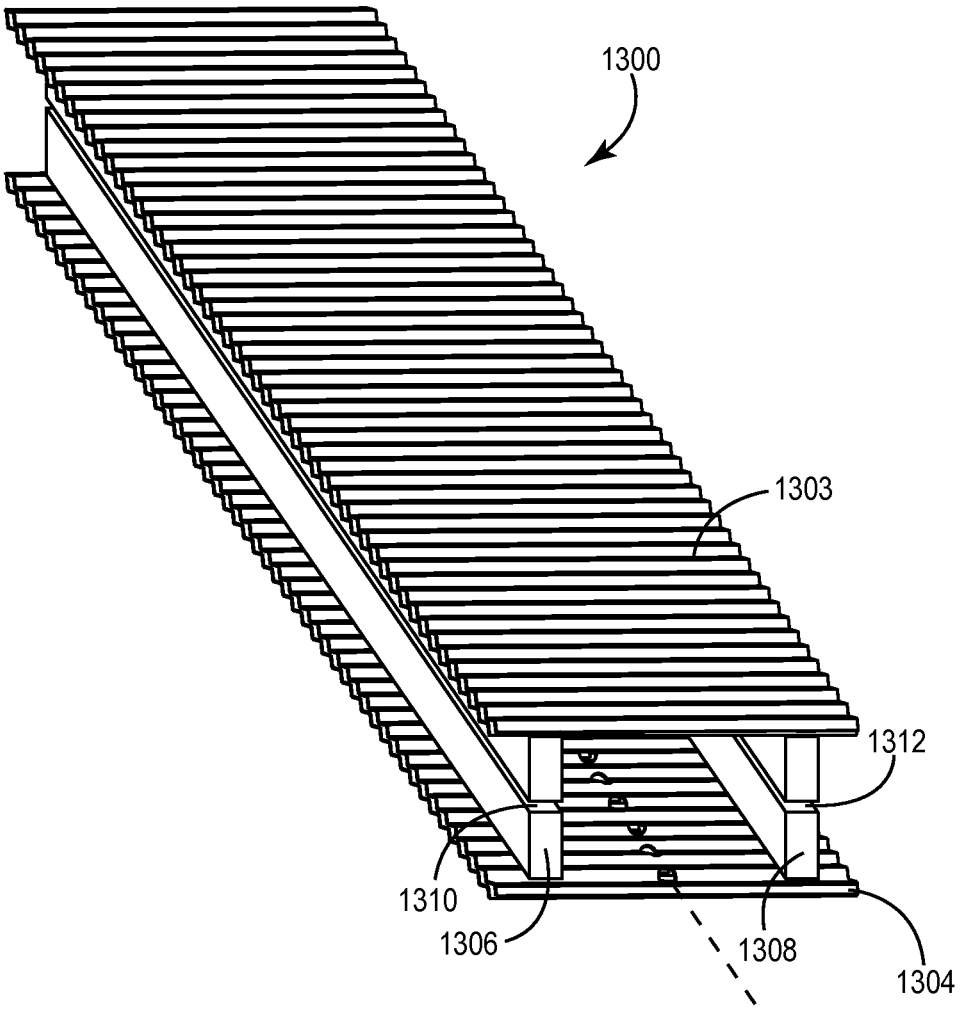
FIG. 14 depicts a perspective view of yet another spacer embodiment.
Figure 15:
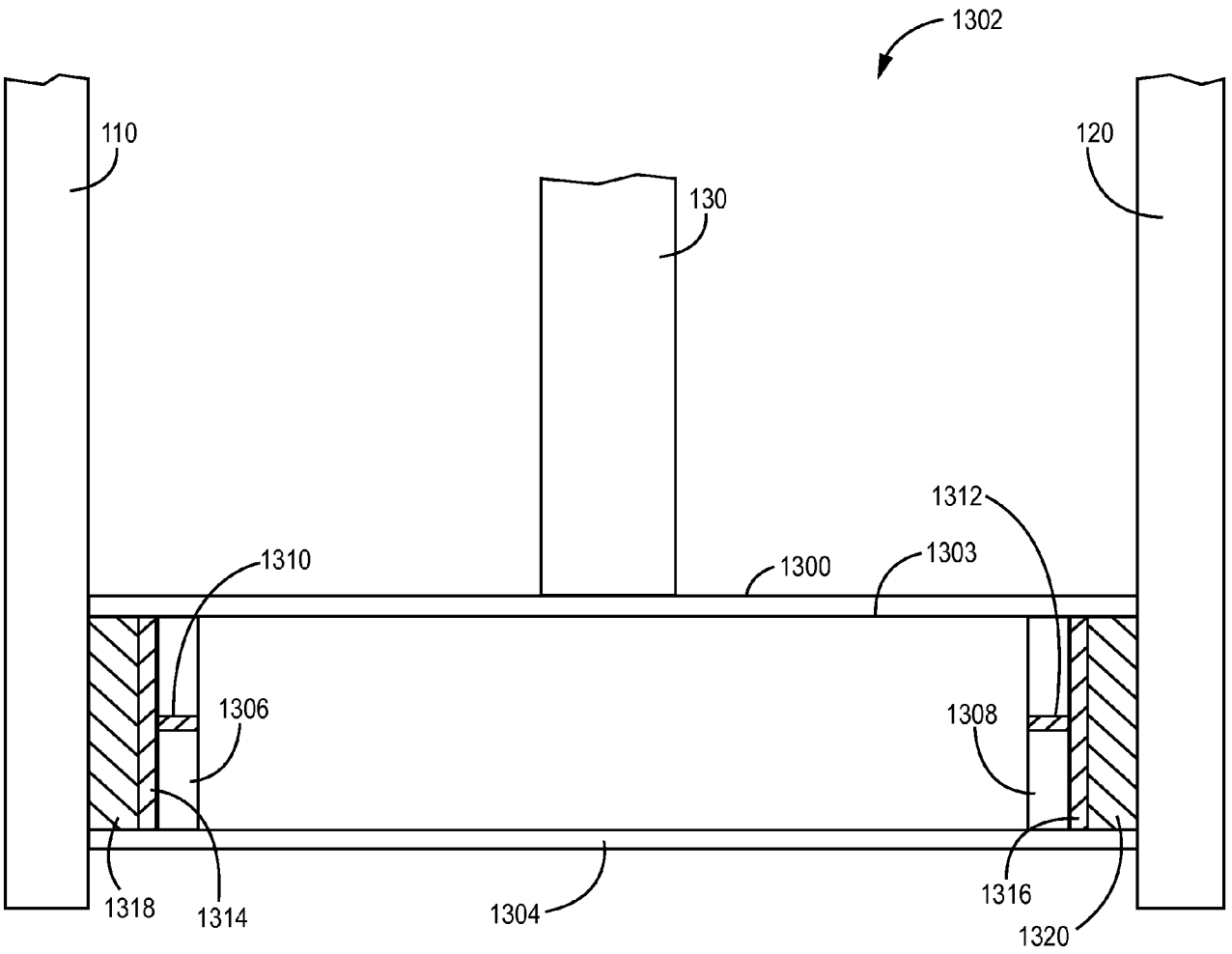
FIG. 15 depicts a cross-sectional view of a window unit incorporating the spacer of FIG. 13.

In one embodiment, consistent with a spacer having support legs, the outer support legs are slit and then reconnected with a sealant. In one embodiment, one of the outer support legs is slit and then reconnected with a sealant. A slitting step improves the flexibility and twistability of the spacer. FIG. 14 shows a spacer 1300 having two split support legs and FIG. 15 shows the spacer 1300 incorporated into a window unit 1302. The spacer 1300 includes an inner elongate strip 1303 and an outer elongate strip 1304, with two support legs 1306, 1308 extending between the elongate strips 1303, 1304. The support legs 1306, 1308 each define a slit 1310, 1312, respectively. In one embodiment, the slits 1310, 1312 are located near about the midpoint of one or more of the support legs 1306, 1308. In other embodiments, each slit is located at other locations along one or more of the support legs. The use of a slit in the outer support legs could be used in conjunction with any of the spacers described herein, and is not limited to the spacer 1300, of FIGS. 14 and 15.

Now referring to FIG. 15, a cross section of a portion of a window unit 1302 is shown, incorporating a spacer 1300 with split outer support legs. A cutting blade can be used to create the split 1310 in the first support leg 1306 and the split 1312 in the second support leg 1308. As a next step, a sealant 1314, 1316 can be applied to the support legs 1306, 1308 to re-seal each split 1310, 1312 and cover the outer surfaces of the support legs 1306, 1308. The splitting and then application of sealant 1314, 1316 provides improved flexibility to the spacer compared to before the support leg 1306, 1308 was split. One example of a sealant 1314, 1316 that can be used is HL-5160 available from H.B. Fuller. Other sealants described herein can also be used in some embodiments.

In one embodiment, the sealant 1314, 1316 is applied during the manufacturing process of the spacer 1300 and then the spacer 1300 is reeled onto a spool for storage until the window units or glazing units are manufactured. At the time that the glazing units are manufactured, such as unit 1302, a second sealant 1318, 1320 is applied in the sealant channels as shown in FIG. 15. This approach results in a reduced volume of the second sealant 1318, 1320 applied at the time of manufacturing the glazing units, due to the fact that some of the volume of the sealant cavity is occupied by the first sealant 1314, 1316. A sealant such as PIB is used in one embodiment for the second sealant 1318, 1320 and forms a good bond to the HL-5160. Other sealants described herein can also be used in some embodiments as the second sealant 1318, 1320. The approach of applying a first sealant 1314, 1316 at the time of manufacturing the spacer and a second sealant 1318, 1320 at the time of manufacturing the window assembly allows more flexibility in the choice of the first sealant, since more curing time will be possible for the first sealant before it is incorporated into a window unit in one embodiment. The first sealant 1314, 1316 and second sealant 1318, 1320 may be different sealant compositions in one embodiment. The first sealant 1314, 1316 and second sealant 1318, 1320 may be the same sealant compositions in one embodiment.

In some embodiments, the filler described in the various embodiments is a deformable material. In some embodiments, filler is a desiccant or includes a desiccant that acts to remove moisture from the first air space and the second air space. Desiccants include molecular sieve and silica gel type desiccants. One example of a desiccant is a beaded desiccant, such as PHONOSORB® molecular sieve beads manufactured by W. R. Grace & Co. of Columbia, Md. If desired, an adhesive is used to attach beaded desiccant within the spacer. Other options for incorporating a desiccant into a spacer are described in U.S. Provisional Application 61/716,861, filed on Oct. 22, 2012 and entitled, "SPACER HAVING A DESICCANT" and in the other related applications incorporated by reference herein.

In some embodiments, the filler provides support to the elongate strips of the spacer. In embodiments that include filler, the filler occupies an interior cavity or interior space, or multiple interior cavities or interior spaces. The presence of the filler can reduce thermal transfer through the elongate strips. In some embodiments, the filler is a matrix desiccant material that not only acts to provide structural support between the elongate strips, but also removes moisture from the interior spaces of the window assembly.

Examples of a filler material include adhesive, foam, putty, resin, silicone rubber, or other materials. Some filler materials are a desiccant or include a desiccant, such as a matrix material. Matrix material includes desiccant and other filler material. Examples of matrix desiccants include those manufactured by W.R. Grace & Co. and H.B. Fuller Corporation. In some embodiments a beaded desiccant is combined with another filler material.

The elongate strips described in the spacer embodiments herein are typically long and thin strips of a solid material, such as a metal or plastic. In one embodiment, the elongate strips are formed from material with repeating undulations, as will be further described herein.

An example of a suitable metal for the elongate strips is stainless steel. Other materials can also be used for the elongate strips. An example of a suitable plastic is a thermoplastic polymer, such as polyethylene terephthalate. In some embodiments, a material with low or no permeability is be used. Some embodiments include a material having a low thermal conductivity. In at least one embodiment, an outer elongate strip is constructed of a different material than the inner elongate strip or strips. In other embodiments, the elongate strips are constructed of the same or substantially similar materials.

In one embodiment, the thickness of the material of the elongate strip is 0.003 inch (0.076 mm) or less. In another embodiment, the thickness of the material is 0.0025 inch (0.063 mm) or less. In one embodiment, the thickness of the material is 0.0015 inch (0.038 mm) or more. In one embodiment, the thickness of the material is 0.001 inch (0.025 mm) or more. In one embodiment, the material thickness is about 0.002 inch (0.05 mm) or less.

In one embodiment, the thickness of the material of the elongate strip is 0.002 inch (0.05 mm) or more. In one embodiment, the material thickness is 0.003 inch (0.076 mm) or more. In one embodiment, the material thickness is 0.004 inch (0.10 mm) or more. In one embodiment, the material thickness is 0.005 inch (0.13 mm) or more. In one embodiment, the material of the elongate strip is 0.006 inch (0.15 mm) or less. In some embodiments, the material of at least one of the elongate strips is stainless steel and the material has one of the thickness dimensions described herein.

On their own, the elongate strips are generally flexible, including both bending and torsional flexibility. In some embodiments, bending flexibility allows the resulting spacer to be bent to form non-linear shapes (e.g., curves). Bending and torsional flexibility also allows for ease of window manufacturing. Such flexibility includes either elastic or plastic deformation such that the elongate strips do not fracture during installation into a window assembly. In one embodiment, the elongate strips are made of metal, for example stainless steel, and the window spacer is at least partially flexible. In some embodiments, the elongate strips are substantially rigid. In some embodiments, the elongate strips are flexible, but the resulting spacer is substantially rigid. In some embodiments, the elongate strips act to protect a filler from ultraviolet radiation.

In many of the embodiments, one of more of the elongate strips in a spacer have an undulating shape. In some embodiments, the elongate strips are formed of a metal ribbon, such as stainless steel, which can then be bent into the undulating shape. One of the benefits of the undulating shape is that the flexibility of the elongate strips is increased, including bending and torsional flexibility. The undulating shape resists permanent deformation, such as kinks and fractures. This allows the elongate strips to be more easily handled during manufacturing without damaging them. The undulating shape can also increase the structural stability of the elongate strips to improve the ability of spacer to withstand compressive and torsional loads. In addition, the undulating elongate strip will conform to the shape that it surrounds. Around corners, the outer undulating elongate strip will be under tension, while the inner undulating elongate strip will be under compression in some embodiments. As a result, it is easier to execute shaping of the spacer around an object such as a pane of glass. The use of undulations on the elongate strips allows the use of much thinner material than if material without undulations were used since the undulating material is more resistive to compressive forces and provides a larger surface area at its edge for bonding to the glass via the sealant or adhesive. As a result of the thinner material, much better thermal properties are observed in the resulting window assembly because less material in the spacer results in less material available to conduct heat. In addition, the increased surface area distributes forces present at the intersection of an edge of the elongate strip and a surface of the one or more sheets to reduce the chance of breaking, cracking or otherwise damaging the sheet at the location of contact.

Figure 3:
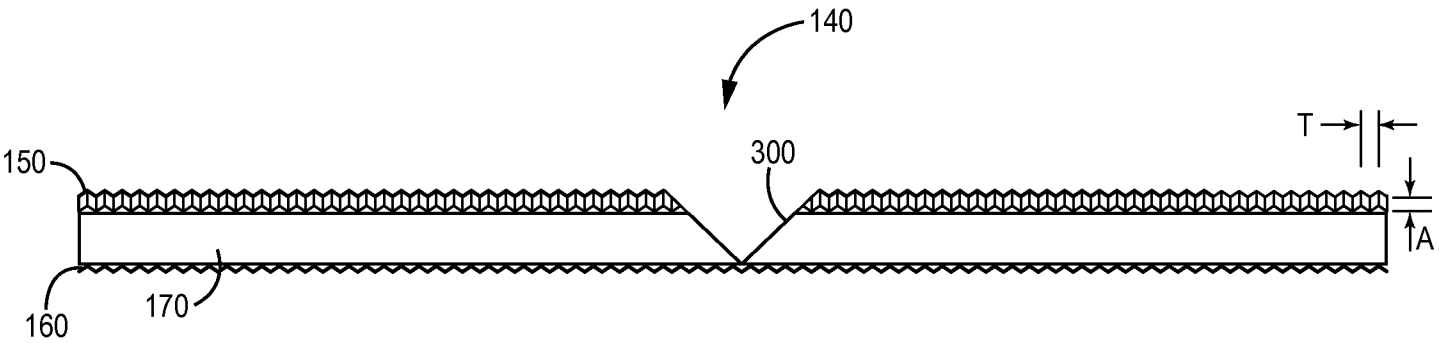
FIG. 3 depicts a side view of a portion of the spacer component of FIGS. 1 and 2, consistent with the technology disclosed herein.

Some possible embodiments of the undulating shape of the elongate strips include sinusoidal, arcuate, square, rectangular, triangular, and other desired shapes. The shape of the undulating strip can be a relatively consistent waveform having a peak-to-peak amplitude A, as shown in FIG. 3, which can also be referred to as the overall thickness of the elongate strip 150, 160, which is distinguished from the thickness of the material itself The shape of the undulating strip can also have a relatively consistent peak-to-peak period, T as shown in FIG. 3. In some embodiments, the overall thickness A of the first elongate strip 150 and the second elongate strip 160 is about 0.005 inch (0.13 mm) or more, about 0.1 inch (2.5 mm) or less, about 0.02 inch (0.5 mm) or more, about 0.04 inch (1 mm) or less, about 0.01 inches (0.25 mm) or more, about 0.02 inches (0.5 mm) or less, and 0.012 inch (0.3 mm) in one embodiment.

In one embodiment, the peak-to-peak period of the undulations in the first and second elongate strips 150, 160 is 0.012 inch (0.3 mm) or more. In some embodiments, the peak-to-peak period of the undulations is 0.01 inch (2.5 mm) or less, 0.05 inch (1.27 mm) or less, or 0.036 inch (0.91 mm). Larger waveforms can be used in other embodiments. Other embodiments can include other dimensions.

The dimensions of the peak-to-peak period and peak-to-peak amplitude of the second elongate strip impact the performance and shape of the spacer around corners. Combinations of the minimum values for the amplitude and period described herein enable the formation of a corner without distorting or breaking the second elongate strip. In one embodiment, a peak-to-peak period is 0.012 inch (0.3 mm) or more and the amplitude is 0.005 inch (0.13 mm) or more. In one embodiment, a peak-to-peak period is 0.012 inch (0.3 mm) or more and the amplitude is 0.01 inches (0.25 mm) or more.

Some embodiments of the first elongate strip 150 and the second elongate strip 160 are formed of materials other than metals, and can be formed by more appropriate processes, such as molding. Note that while the Figures show elongate strips having similar undulations, it is contemplated that one elongate strip in a spacer may have an undulating shape that is much larger than the undulating shape of another elongate strip. Another possible embodiment includes a flat elongate strip without undulations combined with an elongate strip with an undulating shape. Other combinations and arrangements are also possible.

The elongate strips in a particular spacer may each have an undulating shape that extends across the width of each strip, in some embodiments, or may have a portion of planar, non-undulating material in the center of each strip.

Referring back, for example, to FIG. 1, the first sheet 110, the second sheet 120 and the intermediate sheet 130 are generally made of a material that allows at least some light to pass through. Typically, first sheet 110, second sheet 120 and intermediate sheet 130 are made of a substantially planar, transparent material, such as glass, plastic, or other suitable materials. Alternatively, a translucent or semi-transparent material is used, such as etched, stained, or tinted glass or plastic. It is also possible for first sheet 110, second sheet 120 and intermediate sheet 130 to be opaque, such as decorative opaque sheets. In some embodiments the first sheet 110, second sheet 120 and intermediate sheet 130 are all the same type material. In other embodiments, the first sheet 110, second sheet 120 and intermediate sheet 130 are different types of materials. In other embodiments, the first sheet 110 and the second sheet 120 are the same material, while the intermediate sheet 130 is a different material. In one embodiment, the intermediate sheet includes plastic and the first and second sheets include glass. In one particular embodiment, the intermediate sheet 130 has a smaller thickness that the first sheet 110 and the second sheet 120, although other configurations are possible. In a variety of embodiment, there can be multiple intermediate sheets. In at least one embodiment, there are two intermediate sheets.

When the window assembly 100 is assembled, a first air space 180 is defined between the first sheet 110 and the intermediate sheet 130, and a second air space 190 is defined between the second sheet 120 and the intermediate sheet 130. In embodiments where there are multiple intermediate sheets, additional air spaces will be defined.

When the window assembly 100 is fully assembled, a gas is sealed within a first air space 180, defined between the first sheet 110 and the intermediate sheet 130, and a second air space 190, defined between the second sheet 120 and the intermediate sheet 130. In embodiments where there are multiple intermediate sheets, additional air spaces will be defined. In some embodiments, the gas is air. In some embodiments, the gas includes oxygen, carbon dioxide, nitrogen, or other gases. Yet other embodiments include an inert gas, such as helium, neon or a noble gas such as krypton, argon, xenon and the like. Combinations of these or other gases are used in other embodiments. In the embodiment of FIG. 1, the intermediate sheet 130 is positioned to be approximately equidistant from the first sheet 110 and the second sheet 120, so the width of the first air space 180 is approximately equal to the size of the second air space 190. However, other configurations with differently-sized air spaces are also possible.

Many different options are available for the particular width of the first air space and the second air space, as set forth in the chart below. In some embodiments, the width is about ⅛ inch (3.2 mm) or more, about ¼ inch (6.3 mm) or more, and about ⅜ inch (9.5 mm) or more. In some embodiments, the width is about ½ inches (12.7 mm) or less, about 1½ inch (3.8 cm) or less, about 1¼ inch (3.2 cm) or less and about 1 inch (2.5 cm) or less. In some embodiments, the width is about ¼ inch (6.3 mm), about ⅜ inch (9.5 mm), about ½ inch (12.7 mm) and about ⅝ inch (15.9 mm). In some embodiments, the width ranges from ¼ inch to ½ inch (6.3 mm to 12.7 mm).

In some embodiments, the structure of the spacer, window assembly or both results in fluid communication between the two air spaces. In some embodiments, sealant is present at the outer perimeter of intermediary sheet 130 only intermittently. For example, the sealant 179 may be present along the outer perimeter of the intermediate sheet 130 for six inches, and then absent for six inches, then present for six inches, and so on. Other dimensions describing the intervals for the sealant presence are possible. In this type of configuration, air can pass between the first and second air spaces around the outer perimeter of the intermediate sheet at the locations where no sealant is present.

In one configuration, small openings are present in the intermediate sheet 130 to allow fluid communication between the two air spaces. The small openings are located near the outer perimeter but not overlapping with the sealant.

In some embodiments, the two inner elongate strips 150, 151 or single inner elongate strip of the spacer defines a plurality of apertures 152. Apertures 152 allow gas and moisture to pass through the inner elongate strip or strips 150, 151. As a result, moisture located within the first air space 180 and the second air space 190 is allowed to pass through the spacer where it is removed by desiccant in the filler.

Another consequence of the first and second spaces being in fluid communication is that the two air-tight seals instead of four air-tight seals are required to maintain the isolation of the first and second spaces from the exterior atmosphere. As a result, there are half as many potential points of failure in the sealing structure. In addition, the quantity of sealant or adhesive and filler material is reduced.

Also, wind load is transferred directly from the first sheet of material to the second sheet of material in constructions where there is fluid communication between the first and second air spaces. In contrast, in a triple pane construction where the first and second spaces are sealed from each other, the wind load is transferred from the first sheet to the intermediate sheet and then to the second sheet. As a result, the intermediate sheet needs to be mechanically capable of bearing the wind load in such a construction. In contrast, in embodiments where there is fluid communication between the first and second air spaces, the intermediate sheet can be constructed from a thinner material and using different material than the first and second sheets, since the intermediate sheet will not need to withstand wind load.

In one embodiment, gilling may be used to form and define the apertures 152. Generally, "gilling" refers to the introduction of a plurality of discontinuous slits on the surface of the elongate strip prior to forming the undulations of the elongate strip. One manner of introducing the plurality of discontinuous slits on the elongate strip is by passing the elongate strip through a pair of rollers, where at least one roller defines a plurality of discontinuous protrusions and a mating roller defines a plurality of discontinuous mating receptacles. After the introduction of the plurality of discontinuous slits to an elongate strip, undulations can be formed in the elongate strip. In one embodiment the length of each slit is approximately 0.125 inches (3.17 mm) in length. In one embodiment, the apertures are elongate slits.

In one example, the apertures are circular openings with a diameter in a range from about 0.002 inches (0.051 mm) to about 0.050 inches (1.27 mm) In one example, apertures 152 have a diameter of 0.030 inch (0.76 mm) and in another example, the apertures 152 have a diameter of 0.015 inch (0.38 mm) In various embodiments, the apertures 152 have a center-to-center spacing of 0.002 inch (0.051 mm) or more, 1 inch (25.4 mm) or less, and for example 0.060 inch (1.52 mm) Apertures are made by any suitable method, such as cutting, punching, drilling, laser forming, or the like. In another embodiment, apertures are used for registration of the intermediate sheet. In yet another embodiment, apertures provide reduced thermal transfer.

Some embodiments of spacer are made according to the following process. Embodiments with support legs will now be discussed. Support legs or structural elements are formed and positioned between elongate strips with a die component, in some embodiments. In one possible embodiment, each elongate strip that makes up the spacer is passed through an elongate strip guide in the die. The guides orient the elongate strips in a generally parallel and facing arrangement and space them a desired distance apart. An extrusion die is arranged near the guide and between elongate strips. As the elongate strips pass through the guide, a support leg material and/or structural element is extruded into a mold between elongate strips. Extrusion typically involves heating the material and using a hydraulic, or other, press to push the material through the extrusion die. The guide also presses the extruded support legs or structural element against interior surfaces of elongate strips, such that the support legs conform to the undulating shape and are connected to elongate strips.

In one embodiment, before the elongate strips are joined and the support legs and/or structural element is formed, filler is positioned on at least one of the elongate strips. In one embodiment, the filler is not placed at the corner locations. An automated control component can be used to control the filler application equipment to accomplish this placement. In one embodiment, filler is inserted between the elongate strips, and between the support legs during the process of forming the spacer. In one embodiment, the filler is inserted between the elongate strips after the sidewalls and/or structural element has been formed to join the elongate strips.

After formation of the spacer, in some embodiments the spacer is sufficiently flexible that it can be wrapped around and stored on a spool without damaging the spacer. In various embodiments, the spacer can be wrapped around a spool core having a diameter of 18 inches or more, 12 inches or more, 10 inches or more, 6 inches or more, 4 inches or more, and 3.5 inches or more without being damaged. Examples of damage include the separation of one or more of the support legs from one or more of the elongate strips.

In some embodiments, the spacer is sufficiently twistable that a length of about 28 inches of spacer can be twisted by 180 degrees in a positive direction and 270 degrees in a negative direction without being damaged. In some embodiments, the spacer is sufficiently twistable that a length of about 28 inches of spacer can be twisted by about 90 degrees in a positive direction and about 180 degrees in a negative direction without being damaged. In some embodiments, the spacer is sufficiently twistable that a length of about 9 inches of spacer can be twisted by about 90 degrees while one end is held fixed without being damaged.

The sheets of material used in windows can be a variety of shapes and may have corners. In multiple embodiments the sheets are rectangular and have four ninety degree angles. As such, the spacers can be configured to be positioned adjacent to the perimeter of a sheet including accommodating the shape of the corners. Corner notches, an example of which is illustrated in FIG. 3 at corner notch 300, can be defined along the length of the spacer. Each corner notch 300 is positioned to correspond with the location of the corners of the sheets of material. The corner notches 300 are generally V-shaped. Each notch 300 extends through the inner elongate strips or strip and any support legs or structural element. In one embodiment, the notch 300 defines an angle that is about 90 degrees.

The corner notching or corner registration process allows the formation of a true corner, either ninety degrees or another angle, by the inner elongate strip or strips of the spacer and therefore allows the use of a true ninety degree corner on the intermediary sheet of material such as glass. As a result, it is not necessary to create a radius at each corner of the sheet, which is significantly more efficient in the glass cutting process than creating a radius at corners. At the corners of the window assembly, the outer elongate strip is bent and forms a radius in some embodiments. In various embodiments, the radius of the outer elongate strip after being applied around a corner of a sheet is about 0.25 inch (6.35 mm), about 0.1 inch (2.54 mm) or more or about 0.5 inch (12.7 mm) or less. An advantage of this configuration is that the equipment that applies sealant or adhesive is not required to come to a stop, but can simply slow down, as it travels around the corners of the window assembly.

In at least one embodiment, the spacer is fed into a corner registration mechanism to define the corner notches. The corner registration mechanism is adapted to score the spacer at defined locations. In the subject embodiment, the corner registration mechanism is adapted to cut notches into the spacer at given intervals. In the notching process, a portion of the first elongate strip is removed and a portion of any support legs or structural element is removed at each notch location. In one embodiment, the system includes an automated control system that is programmed with the dimensions of the spacers that are required for making the next window assemblies, and is operatively coupled to the components of the assembly system. The automated control component can thereby calculate the specific locations in the roll where particular spacer lengths will begin and end, and the corner locations for those spacers. The intervals between the adjacent notches are chosen based on the dimensions of the sheets. As the spacer is fed through the corner registration mechanism, the notches are cut by the corner registration mechanism at the corner locations.

After formation of the spacer, and optionally after unwinding from a spool and cutting of the corner notches, the spacer can be cut to an appropriate length, such as sufficiently long to be positioned at the entire perimeter of a window assembly. Adhesive or sealant is deposited on a surface of the spacer that is configured to receive the edge of an intermediate sheet. Adhesive or sealant is also placed in the sealant channels at the same time, in some embodiments. An edge of the intermediate sheet is brought into contact with the adhesive on the receiving surface of the first elongate strip, and the spacer is wrapped around the perimeter of the intermediate sheet. A first sheet and second sheet are coupled to the adhesive disposed along each respective side of the spacer. Further details and options regarding embodiments of the assembly process and applicator apparatus are described in U.S. patent application Ser. No. 13/157,866, "WINDOW SPACER APPLICATOR", filed Jun. 10, 2011 and in U.S. Provisional Application No. 61/716,871, titled "VERTICAL LINE MANUFACTURING SYSTEM AND METHOD," filed on Oct. 22, 2012, both of which are incorporated herein in their entireties.

Figure 16:
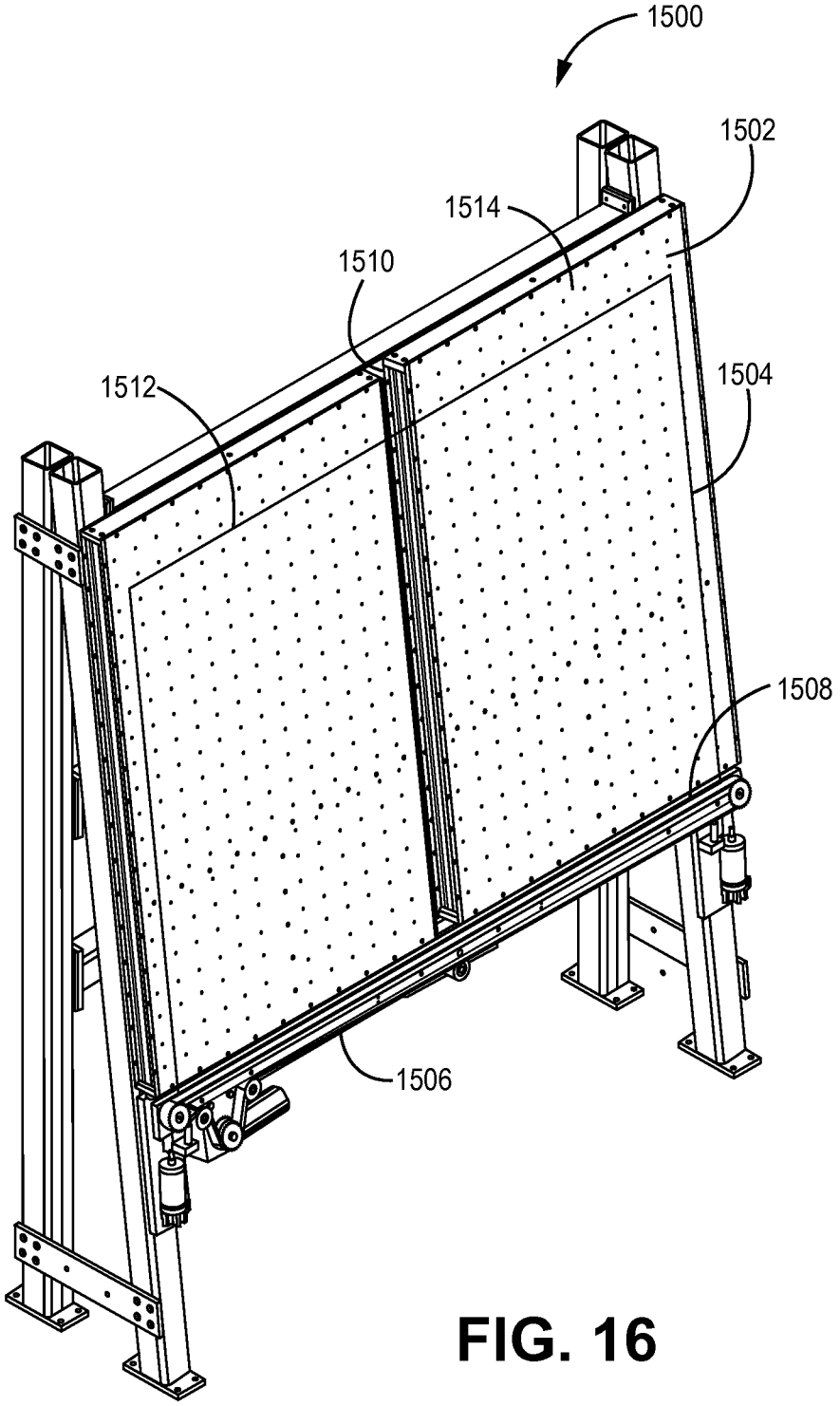
FIGS. 16-17 depict perspective and front views, respectively of a spacer set conveyor embodiment.
Figure 17:
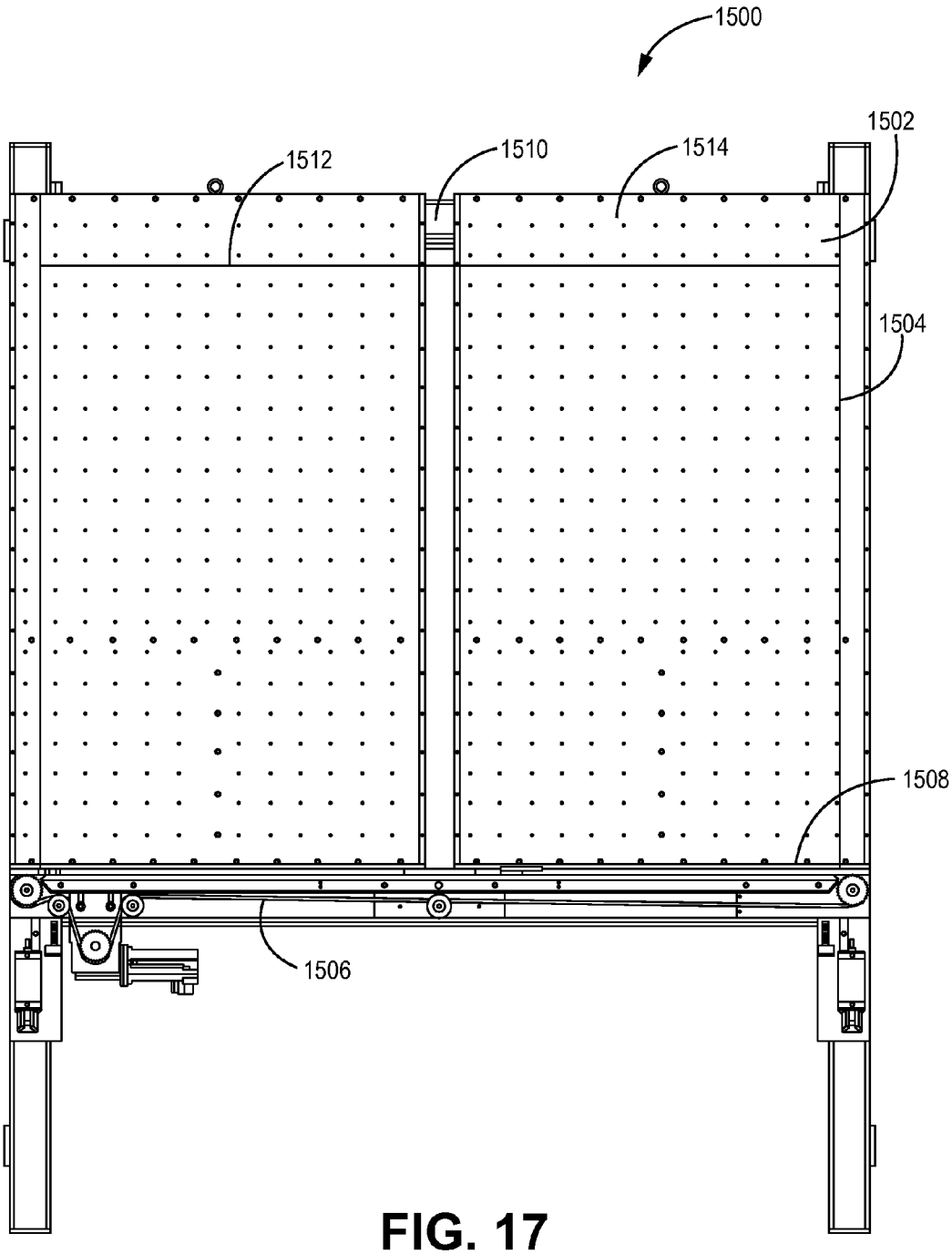

FIGS. 16 and 17 illustrate a spacer set conveyor 1500 that can be used in some embodiments in conjunction with other equipment, such as a spacer applicator, to bring an intermediate pane into contact with the spacer. This equipment facilitates applying a spacer to an intermediate pane without the use of vacuum cups or pads contacting the major surfaces of the intermediate pane. The spacer set conveyor 1500 includes a major surface 1502 upon which a pane 1504 may be supported during a manufacturing process. The spacer set conveyor 1500 also includes a pane conveyor 1506 that supports a bottom edge 1508 of a pane during part of a manufacturing process. The major surface 1502 defines many openings 1514 for providing a vacuum that is capable of holding the pane 1504 against the major surface 1502 as the pane conveyor 1506 drops away from the bottom edge 1508 of the pane 1504. The movement of the pane conveyor 1506 away from the bottom edge 1508 of the pane 1504 provides access to bottom edge 1508 of the pane 1504. The major surface 1502 also defines a center groove or opening 1510. The opening 1510 is large enough to allow a small gripper element on a spacer applicator to grip a top edge 1512 of the pane 1504. The opening 1510 is small enough that when a pane 1504 slides along the major surface 1502 its movement is not disrupted by the opening 1510. At the same time that a gripper contacts the top edge 1512 of the pane 1504, additional gripper elements of a spacer applicator can grip the bottom edge 1508 of the pane 1504. As a result, the opening 1510 provides a mechanism for gripping and manipulating the pane 1504 without the use of suction cups or suction pads contacting one of the major surfaces of the pane 1504. Suction cups or suction pads can leave marks on the pane and so the spacer set conveyor provides an advantage in the manufacturing process.

Figure 18:
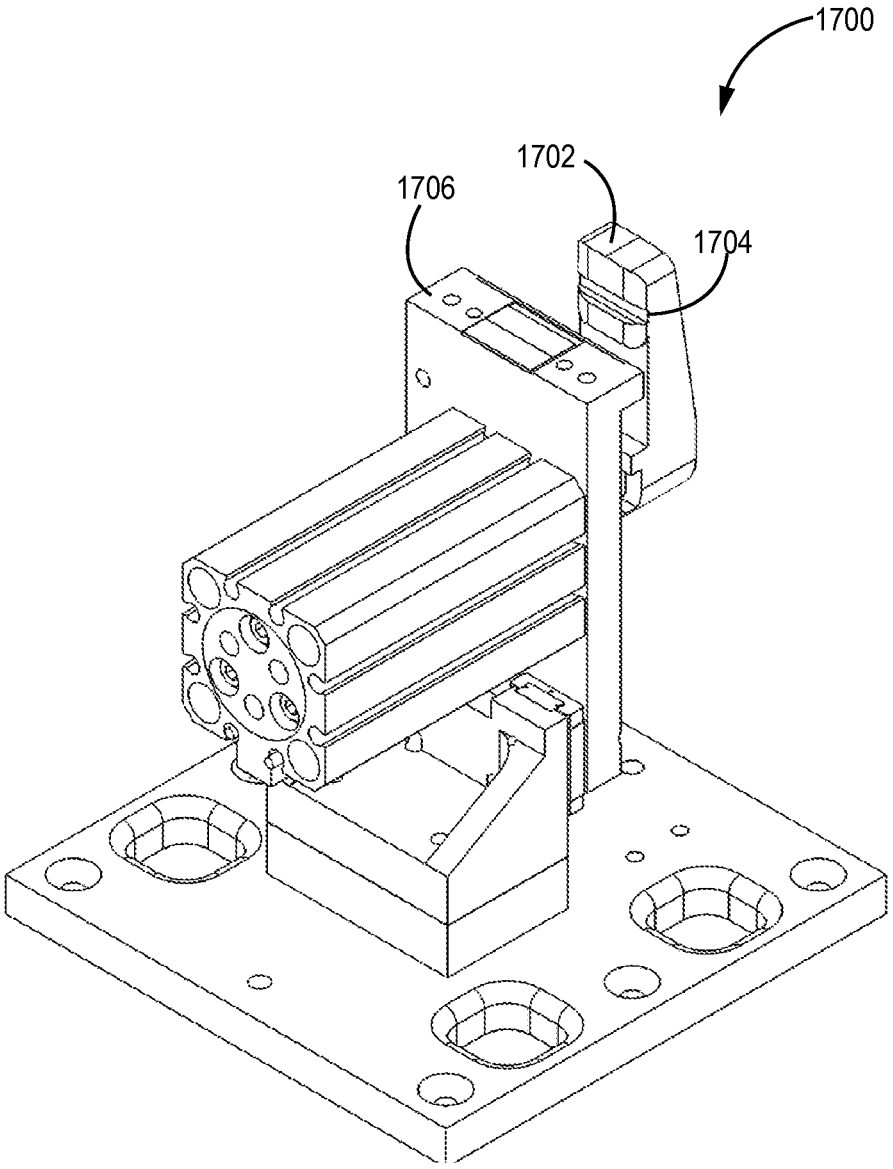
FIGS. 18-20 depict examples of pane retention elements.
Figure 19:
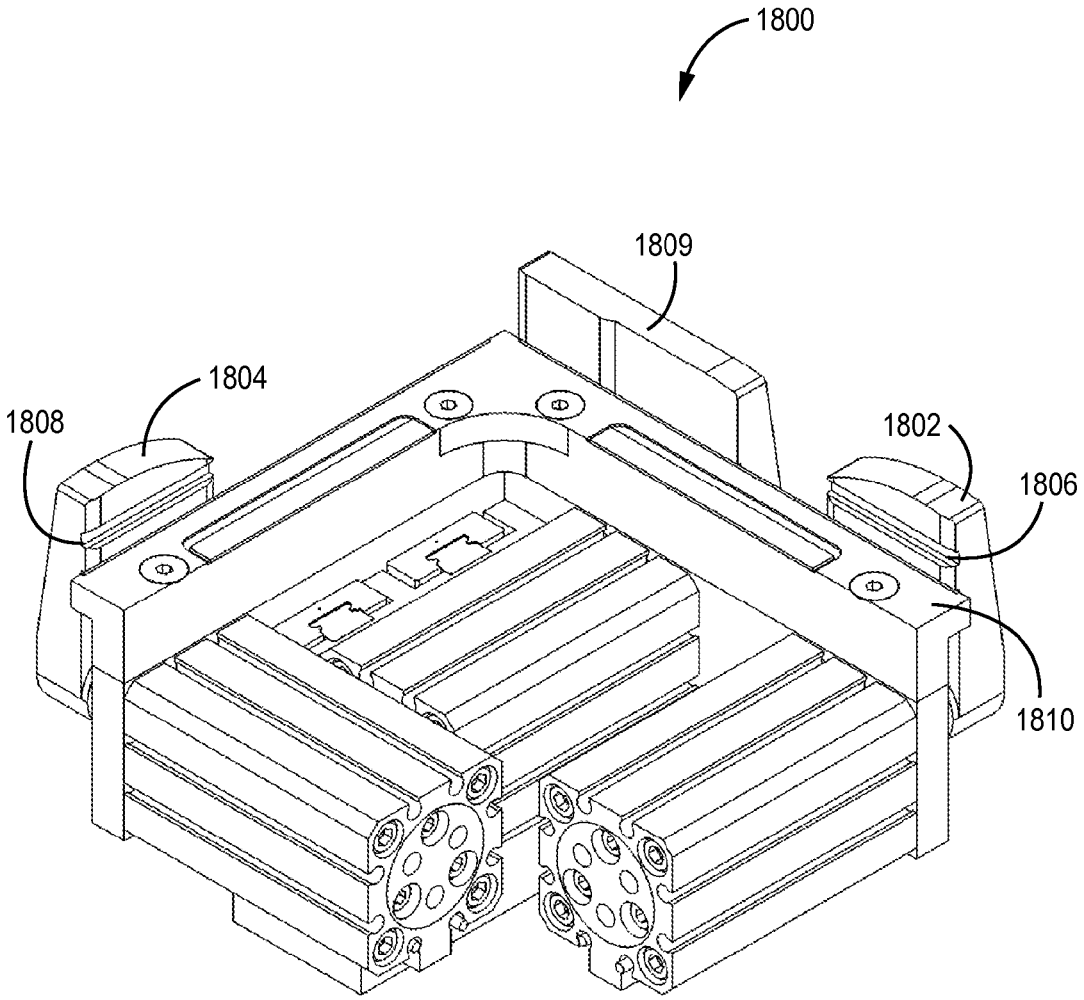
Figure 20:
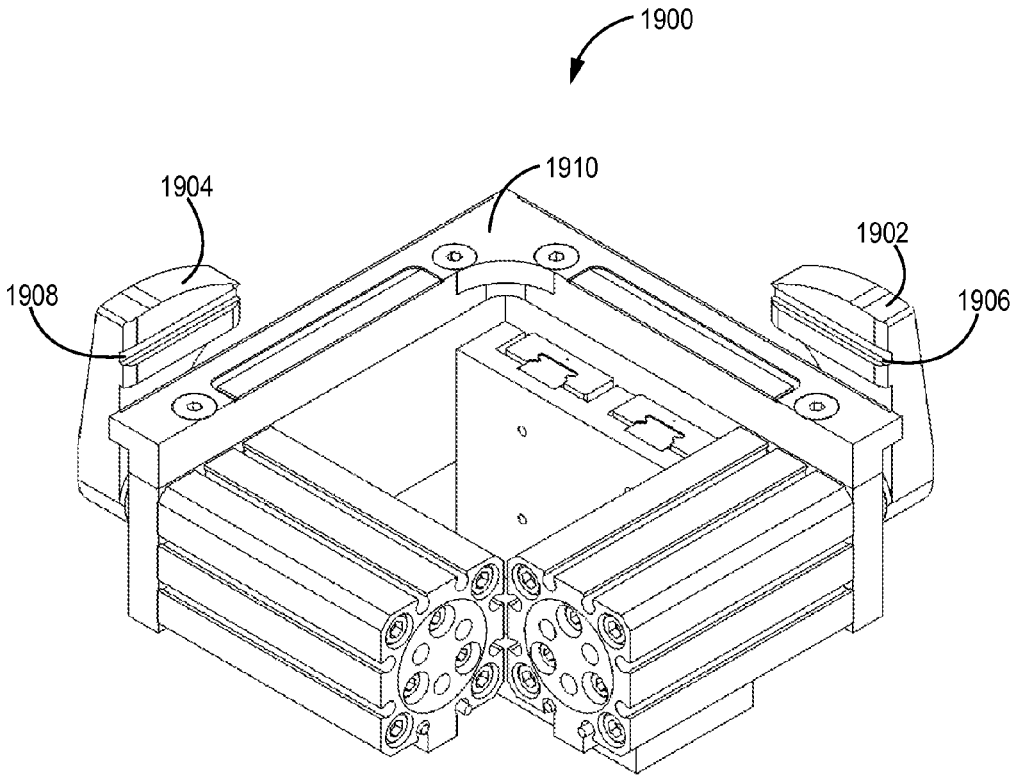

FIGS. 18-20 illustrate examples of pane retention elements that may be used in some embodiments of a spacer applicator that is used in conjunction with the spacer set conveyor of FIGS. 16-17. FIG. 18 shows a center pane retention element 1700 which includes a gripper 1702 and can be positioned at a center of an edge of a pane. The gripper 1702 defines a grove 1704 that can contact an edge of a pane. A plate element 1706 will rest against a major surface of the pane when the gripper 1702 is engaged with the edge of the glass. The center gripper 1702 is sized so that it will fit within the opening 1510 defined in the major surface 1502 spacer set conveyor 1500 (See FIGS. 16 and 17).

FIG. 19 shows a first corner pane retention element 1800 that can be positioned at a corner of a pane, which includes grippers 1802 and 1804 at 90 degree angles to each other. Each gripper 1802, 1804 defines a groove 1806, 1808 for accommodating, gripping and contacting edges of the pane. A third gripper 1809 is present near the corner of the pane retention element 1800 and can be used to further grip the pane or for other retention purposes during the manufacturing process, such as pressing an end tab of a spacer into the proper position. A plate element 1810 will rest against a major surface of the pane when the two grippers 1802, 1804 are contacting the pane.

FIG. 20 shows a second corner pane retention element 1900 that can also be positioned at a corner of a pane and includes grippers 1902 and 1904 at 90 degree angles to each other. Each gripper 1902, 1904 defines a groove 1906, 1908 for contacting edges of the pane. A plate element 1910 will rest against a major surface of the pane when the two grippers 1902, 1904 are contacting the pane. In one embodiment of a spacer applicator device, one first corner pane retention element 1800 is provided, three second corner pane retention elements 1900 are provided, and four center pane retention elements 1700 are provided.

In one embodiment, each of the pane retention elements 1700, 1800, 1900 can be converted to spacer retention elements that grip a spacer and form a spacer into a spacer frame, then apply a spacer frame to a pane of glass in the process of forming a dual pane window unit. This conversion can occur by replacing the plate elements 1706, 1810, 1910 with different plate elements that are configured to allow a spacer element to be gripped between the grippers and the different plate elements.

An example of a system and method for forming a window assembly has been described, but those of skill in the art will be aware of many options and alternatives to the equipment and method steps described that can be used.

Various embodiments are described in detail with reference to the drawings, wherein like reference numerals represent like parts and assemblies throughout the several views. Reference to various embodiments does not limit the scope of the claims attached hereto. Additionally, any examples set forth in this specification are not intended to be limiting and merely set forth some of the many possible embodiments for the appended claims.

We claim:

1. A window unit comprising:

an intermediate pane, the intermediate pane being disposed between first and second outer panes of the window unit;

an outer elongate strip having (i) a length corresponding to a distance between inner surfaces of the outer panes, (ii) a first surface, and (iii) a second surface contacting and supporting the intermediate pane;

first and second inner elongate strips, each having a first surface and a second surface, the inner elongate strips arranged so that each of the first surfaces of the inner elongate strips are spaced from the second surface of the outer elongate strip towards an interior of the window unit, the inner elongate strips being spaced from each other to form an elongate intermediate pane gap;

a first outer support leg extending between the outer elongate strip and the first inner elongate strip;

a second outer support leg extending between the outer elongate strip and the second inner elongate strip;

a first inner support leg extending between the outer elongate strip and the first inner elongate strip, the first inner support leg positioned between the two outer support legs; and a second inner support leg extending between the outer elongate strip and the second inner elongate strip, the second inner support leg positioned between the two outer support legs, wherein the outer elongate strip and the first inner elongate strip each extend a first distance from the first outer support leg to the inner surface of the first outer pane, and wherein the outer elongate strip and the second inner elongate strip each extend a second distance from the second outer support leg to the inner surface of the second outer pane.

2. The window unit of claim 1 wherein the inner support legs are positioned at a non-perpendicular angle to the outer elongate strip.

3. The window unit of claim 1 wherein the first and second outer support leg are spaced from the outer edges of the elongate strips.

4. The window unit of claim 1 wherein the support legs are formed of a different material than the elongate strips.

5. The window unit of claim 1 wherein the support legs are nylon.

6. The window unit of claim 1 wherein the elongate strips are metal.

7. The window unit of claim 1 wherein the elongate strips have an undulating shape.

8. The window unit of claim 1 further comprising at least one filler arranged between the outer elongate strip and the inner elongate strips, the filler including a desiccant.

9. The window unit of claim 1 further comprising an elongate gasket disposed between the first inner elongate strip and the second inner elongate strip, wherein the elongate gasket further defines the intermediate pane gap.

10. A window unit comprising:

a first pane, a second pane, and an intermediate pane disposed between the first pane and the second pane;

a spacer comprising:

an outer elongate strip (i) extending between inner surfaces of the first and second panes, (ii) having a first surface, and (iii) having a second surface contacting and supporting the intermediate pane;

first and second inner elongate strips, each having a first surface and a second surface, the inner elongate strips arranged so that each of the first surfaces of the inner elongate strips are spaced from the second surface of the outer elongate strip towards an interior of the window unit, the inner elongate strips being spaced from each other to form an elongate intermediate pane gap;

a first outer support leg extending between the outer elongate strip and the first inner elongate strip;

a second outer support leg extending between the outer elongate strip and the second inner elongate strip;

a first inner support leg extending between the outer elongate strip and the first inner elongate strip, the first inner support leg positioned between the two outer support legs; and a second inner support leg extending between the outer elongate strip and the second inner elongate strip, the second inner support leg positioned between the two outer support legs, wherein the spacer defines a first sealant cavity comprising sealant between the first pane and the first outer support leg and a second sealant cavity comprising sealant between the second pane and the second outer support leg, wherein the outer elongate strip and the first inner elongate strip each extend a first distance from the first outer support leg to the inner surface of the first pane, and wherein the outer elongate strip and the second inner elongate strip each extend a second distance from the second outer support leg to the inner surface of the second pane.

11. A window unit comprising:

a first pane, a second pane, and an intermediate pane disposed between the first pane and the second pane;

a spacer comprising:

an outer elongate strip extending from an inner surface of the first pane to an inner surface of the second pane and contacting and supporting the intermediate pane;

first inner elongate strip extending from the first pane to the intermediate pane;

a second inner elongate strip extending from the intermediate pane to the second pane;

a first support leg extending between the outer elongate strip and the first inner elongate strip; and a second support leg extending between the outer elongate strip and the second inner elongate strip, wherein the outer elongate strip and the first inner elongate strip each extend a first distance from the first support leg to the inner surface of the first pane, and wherein the outer elongate strip and the second inner elongate strip each extend a second distance from second support leg to the inner surface of the second pane.

12. The window unit of claim 11, further comprising an elongate gasket disposed between the first inner elongate strip and the second inner elongate strip, wherein the elongate gasket frictionally receives the intermediate pane.

13. The window unit of claim 11, further comprising:

a third support leg extending between the outer elongate strip and the first inner elongate strip and arranged between the first support leg and the intermediate pane; and a fourth support leg extending between the outer elongate strip and the second inner elongate strip and arranged between the second support leg and the intermediate pane.

14. The window unit of claim 11, wherein the outer elongate strip, the first inner elongate strip, and the second inner elongate strip have an undulating shape.

15. The window unit of claim 13, wherein:

the first support leg, the outer elongate strip and the first inner elongate strip define a first sealant cavity having a sealant disposed therein, wherein the sealant sealably contacts the first pane; and the second support leg, the outer elongate strip and the second inner elongate strip define a second sealant cavity having the sealant disposed therein, wherein the sealant sealably contacts the second pane.

16. The window unit of claim 2, wherein the first and second inner support legs are arranged at the non-perpendicular angle with respect to the outer elongate strip such that first ends of the first and second inner support legs proximate the outer elongate strip are closer to the intermediate pane than second ends of the first and second inner support legs proximate the first and second inner elongate strips, respectively.

17. The window unit of claim 16, wherein the non-perpendicular angle of the first and second inner support legs with respect to the outer elongate strip provides for easier alignment of the intermediate pane within the elongate intermediate pane gap of the spacer.

18. The window unit of claim 15, wherein the third and fourth support legs, the first and second inner elongate strips, and the outer elongate strip define an intermediate sealant cavity having a sealant disposed therein, wherein the sealant sealably contacts the intermediate pane.

19. The window unit of claim 18, wherein:

the first and third support legs, the first inner elongate strip, and the outer elongate strip define a first filler cavity having a filler disposed therein, the filler comprising a desiccant; and the second and fourth support legs, the second inner elongate strip, and the outer elongate strip define a second filler cavity having the filler disposed therein.

20. The window unit of claim 11, further comprising a thin layer of sealant arranged between the intermediate pane and the outer elongate strip.

* * * * *